US006631963B1

(12) United States Patent
Ando et al.

(10) Patent No.: US 6,631,963 B1
(45) Date of Patent: Oct. 14, 2003

(54) METHOD OF DRIVING PRINT HEAD IN INK JET PRINTER AND INK JET PRINTER

(75) Inventors: Makoto Ando, Tokyo (JP); Yuji Yakura, Kanagawa (JP); Toshio Fukuda, Kanagawa (JP); Hiroshi Tokunaga, Tokyo (JP); Yuichiro Ikemoto, Kanagawa (JP)

(73) Assignee: Sony Corporation (JP)

( * ) Notice: Subject to any disclaimer, the term of this patent is extended or adjusted under 35 U.S.C. 154(b) by 58 days.

(21) Appl. No.: 09/890,421

(22) PCT Filed: Dec. 1, 2000

(86) PCT No.: PCT/JP00/08535

§ 371 (c)(1),
(2), (4) Date: Sep. 18, 2001

(87) PCT Pub. No.: WO01/39981

PCT Pub. Date: Jun. 7, 2001

(30) Foreign Application Priority Data

Dec. 1, 1999 (JP) ..... 11-342267

(51) Int. Cl.[7] ..... B41J 2/155; B41J 2/205
(52) U.S. Cl. ..... 347/15; 347/42; 347/11
(58) Field of Search ..... 347/15, 43, 12, 347/40, 42, 13, 14, 19, 11

(56) References Cited

U.S. PATENT DOCUMENTS

| | | | | |
|---|---|---|---|---|
| 4,463,359 A | | 7/1984 | Ayata et al. | |
| 5,032,851 A | | 7/1991 | Yoshimura | 347/43 |
| 5,160,945 A | * | 11/1992 | Drake | 347/42 |
| 5,581,284 A | * | 12/1996 | Hermanson | 347/43 |
| 6,193,347 B1 | * | 2/2001 | Askeland et al. | 347/15 |
| 6,302,508 B1 | * | 10/2001 | Asauchi et al. | 347/15 |

FOREIGN PATENT DOCUMENTS

| | | |
|---|---|---|
| EP | 348181 | 12/1989 |
| EP | 517520 A2 | 12/1992 |
| EP | 0 551 013 A2 | 7/1993 |
| EP | 0 348 181 B1 | 8/1994 |
| EP | 0 517 520 B1 | 8/1997 |
| EP | 0 822 086 A2 | 2/1998 |
| EP | 0 916 496 A2 | 5/1999 |
| JP | 61-293863 | 12/1986 |
| JP | 2-4523 | 1/1990 |
| JP | 3189165 | 8/1991 |
| JP | 3-189165 | 8/1991 |
| JP | 4-361054 | 12/1992 |
| JP | 10-166558 | 6/1998 |
| JP | 10166558 | 6/1998 |

OTHER PUBLICATIONS

Australian Patent Office Search Report, SG 200104393–4 May 7, 2002.
European Search Report dated Jan. 17, 2003.

* cited by examiner

*Primary Examiner*—Lamson Nguyen
(74) *Attorney, Agent, or Firm*—Rader, Fishman & Grauer PLLC; Ronald P. Kananen, Esq.

(57) ABSTRACT

An ink jet printer (100) ejects ink drops from a plurality of nozzles and drops the ink drops on paper P, thus recording information including a character and/or an image in the form of dots based on the ink drops. The ink jet printer (100) has a line head (120) having a driving element for ejecting ink drops from the nozzles. The ink jet printer (100) causes the line head (120) to scan the same portion on the paper P only once in one print and drives the line head (120) to modulate the diameter of a dot by the number of ink drops, using one or a plurality of ink drops for forming one dot.

14 Claims, 19 Drawing Sheets

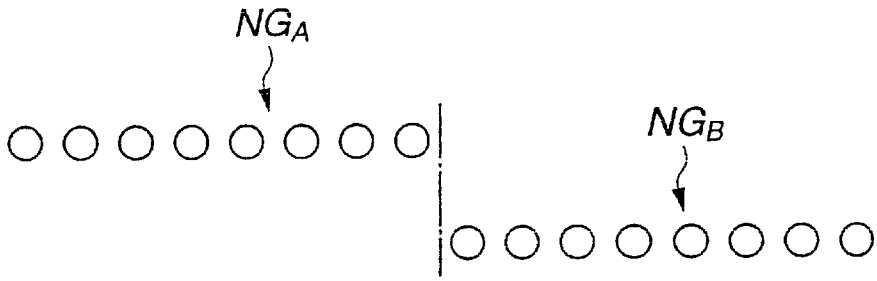
FIG.13
FIG.14A
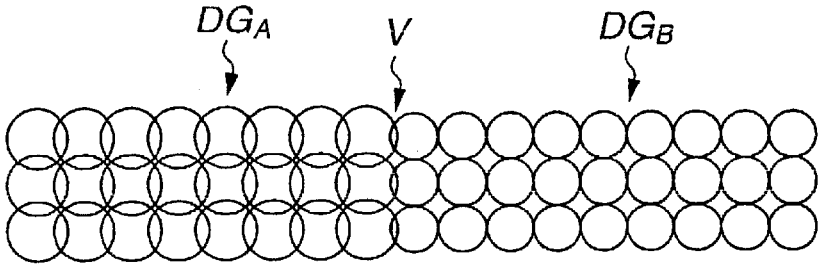
FIG.14B
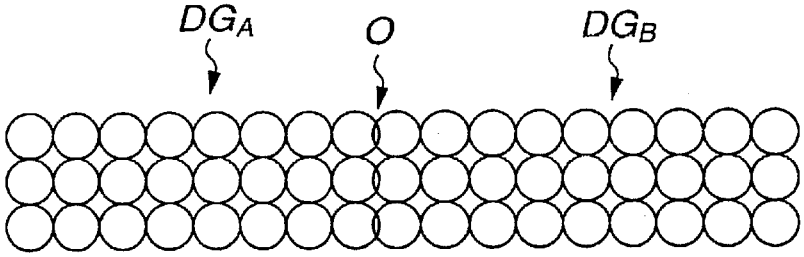
FIG.14C
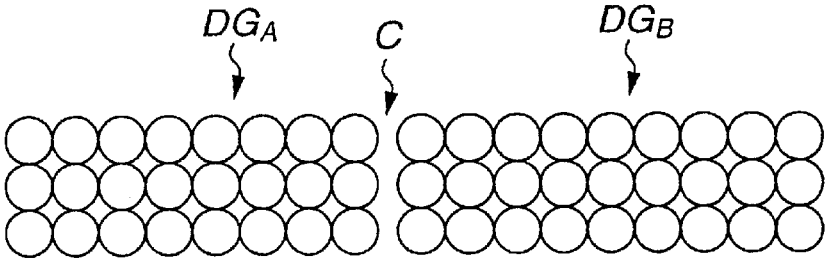
FIG.14D
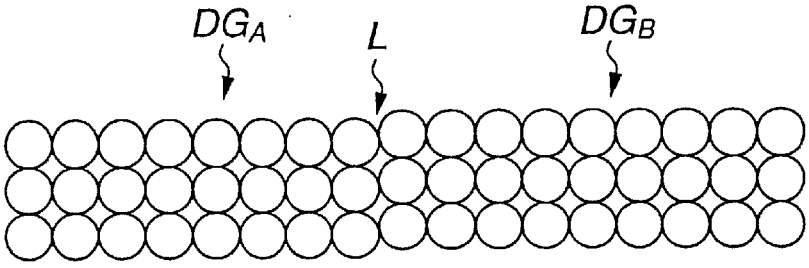

METHOD OF DRIVING PRINT HEAD IN INK JET PRINTER AND INK JET PRINTER

TECHNICAL FIELD

This invention relates to a method for driving a print head in an ink jet printer for ejecting ink drops to record characters and pictures, and an ink jet printer.

BACKGROUND ART

An ink jet printer is a printer of such a type that ink drops are ejected from narrow nozzles arrayed on a print head and are caused to reach a recording medium such as paper, thus recording characters or pictures in the form of dots. This ink jet printer is characterized by a high recording speed, a low recording cost and easy realization of color print.

The print head in the ink jet printer is a so-called serial head which is shorter than the page width of paper, or a so-called line head with a large length which is substantially the same dimension as the page width of paper. The system for ejecting ink drops is a piezo system using a piezoelectric element, or a thermal system using a heating element.

The above-described line head need not be moved in the direction of the page width of paper by driving means such as a motor as in the serial head at the time of recording. Therefore, the line head needs no driving means and it is easy to realize miniaturization of the printer body and reduction in cost. In the thermal system, it is possible to increase the number of driving elements for ejecting ink drops and the array density of the driving elements, more easily than in the piezo system. Therefore, the thermal system is more advantageous to realization of a line head. For these reasons, an ink jet printer having a line head of a thermal system is proposed.

However, the thermal system has drawbacks such as a lower energy efficiency and a larger dissipation power in recording than the piezo system. To overcome these drawbacks, in the ink jet printer, a time-division driving system in which a plurality of heating elements employed in a serial head of the thermal system are divided into several blocks, each of which is driven in a time-divisional manner, must also be applied to a line head of the thermal system.

The ink jet printer generally uses digital image processing by a so-called dither method or an error diffusion method in expressing the gradation. In these methods, however, since the gradation is expressed theoretically using a plurality of dots, the actual resolution is lowered. Moreover, since the rough or granular appearance remains due to the visibility of dots, the picture quality is lowered. Therefore, in the ink jet printer, it is necessary to reduce the rough or granular appearance and to improve the picture quality by reducing the diameter of dots and increasing the array density of dots.

The reduction in diameter of dots can be realized by reducing the size of the heating elements, the diameter of the nozzles and the volume of the chamber, and thus reducing the volume of ink particles to be ejected, with respect to both the line head and the serial head of the thermal system. However, the increase in array density of dots is more difficult with the line head of the thermal system than with the serial head.

Specifically, with the serial head of the thermal system, the array density of dots can be increased relatively easily by raising the ejection frequency of ink drops or reducing the head scanning rate in the head scanning direction, and by reducing the paper feed pitch in the direction of the paper feed direction. On the other hand, with the line head of the thermal system, the array density of the heating elements must be increased in the page width direction, while the array density of dots can be increased in the paper feed direction by a method similar to that of the serial head. This causes increased difficulty of working and assembly of the line head, lower yield, increased scale of the head drive circuit, and hence larger cost and lower reliability.

Moreover, with the serial head of the thermal system, the unevenness in the quantity of ejection of ink drops (dot size and print density) and in the ink drop position is made less visible by a so-called multipath system for recording one line with a plurality of nozzles, often in the high definition mode. On the other hand, with the line head of the thermal system, such a technique cannot be adopted since recording is completed by one scanning operation. Therefore, with the line head of the thermal system, it is important how the unevenness in the quantity of ejection (dot size and print density) for each nozzle and in the ink drop position can be restrained for high definition.

DISCLOSURE OF THE INVENTION

In view of the foregoing status of the art, it is an object of the present invention to provide a method for driving a print head in an ink jet printer which enables realization of an ink jet printer capable of providing a recorded image of a high picture quality with less rough or granular appearance at a high speed, and such an ink jet printer.

According to the present invention, there is provided a method for driving a print head in an ink jet printer in which ink drops are ejected from a plurality of nozzles and dropped on a recording medium so that information including a character and/or an image is recorded in the form of dots based on the ink drops. The method comprises the steps of causing the print head having a driving element for ejecting ink drops from the nozzles to scan the same portion on the recording medium only once in one print, and driving the print head to modulate the diameter of a dot by the number of ink drops, using one or a plurality of ink drops for forming one dot.

In such a method for driving a print head in an ink jet printer according to the present invention, the print head is driven to modulate the diameter of a dot by the number of ink drops.

According to the present invention, there is also provided an ink jet printer for ejecting and dropping ink drops from a plurality of nozzles onto a recording medium and recording information including a character and/or an image in the form of dots based on the ink drops. The ink jet printer has a print head having a driving element for ejecting ink drops from the nozzles. In the ink jet printer, the print head is caused to scan the same portion on the recording medium only once in one print and is driven to modulate the diameter of a dot by the number of ink drops, using one or a plurality of ink drops for forming one dot.

In such an ink jet printer according to the present invention, the print head is driven to modulate the diameter of a dot by the number of ink drops.

BRIEF DESCRIPTION OF THE DRAWINGS

FIG. 13 shows an arrangement of two adjacent groups of nozzles in a conventional line head.

FIG. 14A shows the state of groups of dots recorded by using the head chip of the arrangement shown in FIG. 12 and shows the state where a change point (line) of the diameter of dots is generated on the boundary of groups of dots recorded by using different groups of nozzles.

FIG. 14B shows the state of groups of dots recorded by using the head chip of the arrangement shown in FIG. 12 and shows the state where an overlap of dots is generated on the boundary of groups of dots recorded by using different groups of nozzles.

FIG. 14C shows the state of groups of dots recorded by using the head chip of the arrangement shown in FIG. 12 and shows the state where a gap between dots is generated on the boundary of groups of dots recorded by using different groups of nozzles.

FIG 14D shows the state of groups of dots recorded by using the head chip of the arrangement shown in FIG. 12 and shows the state where a step between dots is generated on the boundary of groups of dots recorded by using different groups of nozzles.

BEST MODE FOR CARRYING OUT THE INVENTION

A preferred embodiment of the present invention will now be described in detail with reference to the drawings.

Figure 1:
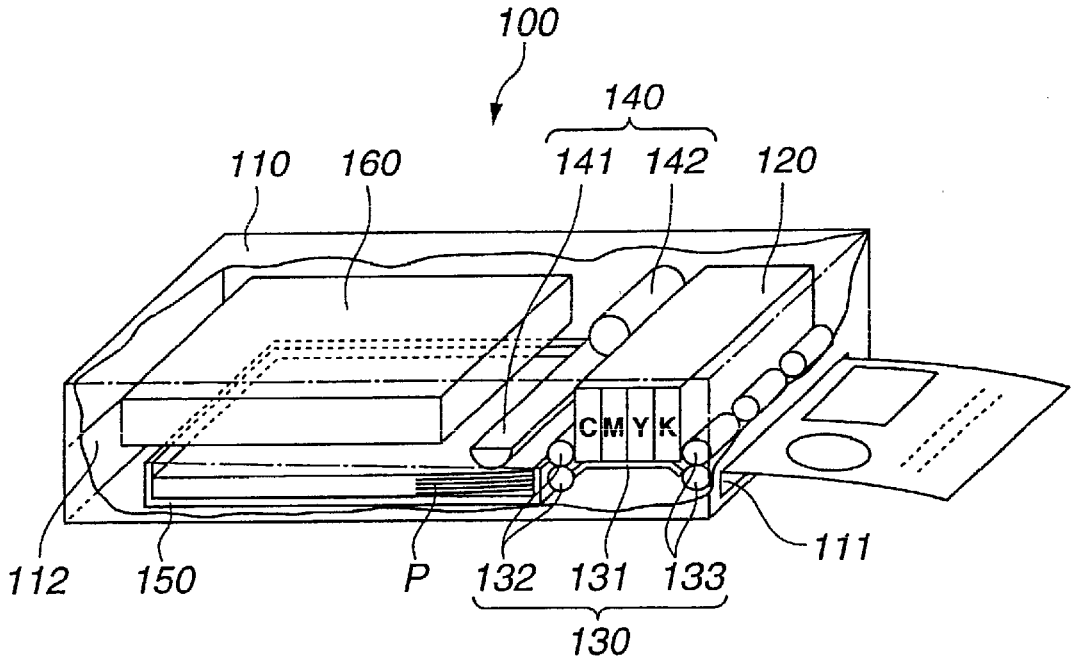
FIG. 1 is a partial cross-sectional perspective view showing the overall structure of an ink jet printer as an embodiment of the present invention.
Figure 2:
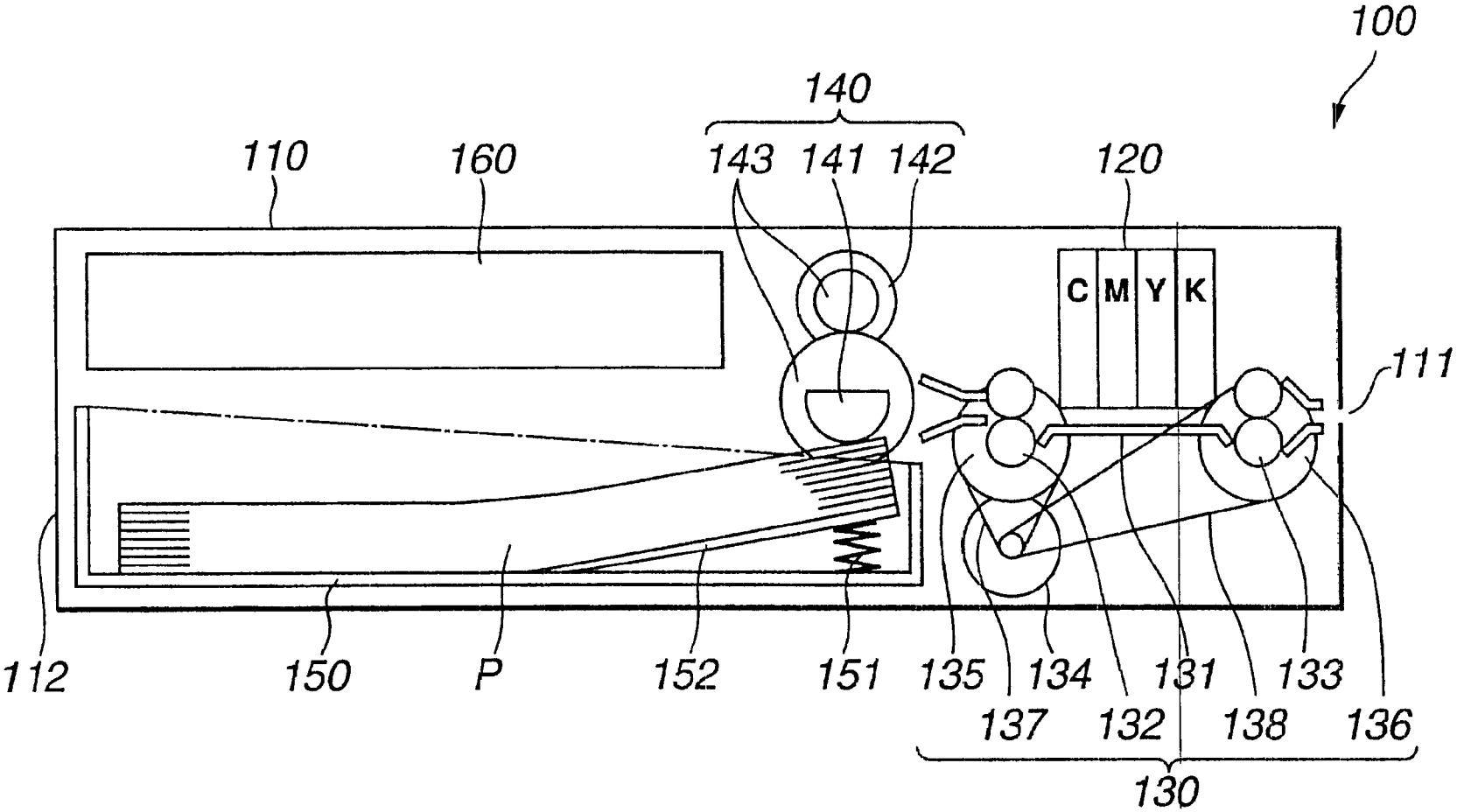
FIG. 2 is a cross-sectional side view showing the ink jet printer.

This embodiment is applied to an ink jet printer 100 having a print head which has a driving element for ejecting ink drops and which has a PNM (pulse number modulation) function such that the same portion on paper P as a recording medium is scanned only once in one print, that is, so-called one-path recording is carried out, while the diameter of a dot is modulated by the number of ink drops, using one or a plurality of ink drops for forming one dot, as shown in FIGS. 1 and 2. By carrying out PNM, this ink jet printer 100 can provide a recorded image of a high picture quality with less rough or granular appearance at a high speed.

In the following description, a line head 120 having a recording range of substantially the same dimension as the page width of the paper P is employed as the print head in the ink jet printer 100. Specifically, the ink jet printer 100, having the line head 120, scans the same portion on the paper P only once in one print, thus performing recording. Moreover, in the following description, the ink jet printer 100 employs a thermal system for ejecting ink drops and uses heating elements as the driving elements.

The ink jet printer 100 has a line head 120 having a recording range of substantially the same dimension as the page width of the paper P, a paper feed section 130 for feeding the paper P into a predetermined direction, a paper supply section 140 for supplying the paper P to the line head 120, a paper tray 150 for housing the paper P, and an electric circuit section 160 for carrying out drive control of these sections, which are provided inside a casing 110 constituting the appearance of the ink jet printer 100.

The casing 110 is formed, for example, in the shape of a rectangular parallelepiped. A paper ejection port 111 for ejecting the paper P is provided on one lateral side of the lateral sides of the casing 110, and a tray inlet/outlet 112 for attaching/detaching the paper tray 150 is provided on another lateral side that is opposite to the one lateral side.

The line head 120 has four colors, for example, CMYK (cyan, magenta, yellow and black). The line head 120 is provided in an upper space at the end on the side of the paper ejection port 111 inside the casing 110, with the nozzles facing downward, though not shown.

The paper feed section 130 has the following constituent elements: a carriage guide 131 constituting a supply path in feeding the paper P; carriage rollers 132, 133 for catching the paper P between them and feeding the paper P; a carriage motor 134 as a driving source for rotationally driving later-described pulleys 135, 136; pulleys 135, 136 for rotationally driving the rollers 132, 133; and belts 137, 138 for transmitting the driving of the carriage motor 134 to the pulleys 135, 136. The paper feed section 130 is provided in a lower space at the end on the side of the paper ejection port 111 inside the casing 110. The carriage guide 131 is formed in the shape of a flat plate and is provided at a predetermined spacing below the line head 120. Each of the carriage rollers 132, 133 consists of a pair of rollers contacting each other. The carriage rollers 132, 133 are provided on both sides of the carriage guide 131, that is, on the side of the tray inlet/outlet 112 and on the side of the paper ejection port 111, respectively. The carriage motor 134 is provided below the carriage guide 131 and is connected with the carriage rollers 132, 133 via the pulleys 135, 136 and the belts 137, 138.

The paper supply section 140 has a paper supply roller 141 for supplying the paper P to the paper feed section 130, a paper supply motor 142 as a driving source for rotationally driving later-described gears 143, and gears 143 rotationally driven by the paper supply motor 142. The paper supply section 140 is provided nearer to the tray inlet/outlet 112 than the paper feed section 130 is. The paper supply roller 141 is formed in a substantially semi-cylindrical shape and is provided near the carriage rollers 132 on the side of the tray inlet/outlet 112. The paper supply motor 142 is provided above the paper supply roller 141 and is connected with the paper supply roller 141 via the gears 143.

The paper tray 150 is formed in a box-like shape capable of housing a plurality of stacked sheets of paper P of A4 size. The paper tray 150 has a paper support 152 which is retained by a spring 151 at one end portion on the bottom side thereof. The paper tray 150 is loaded in a space ranging from below the paper supply section 140 to the tray inlet/outlet 112.

The electric circuit section 160 is a section for controlling the driving of each section and is provided above the paper tray 150.

The ink jet printer 100 as described above carries out the printing operation in the following manner.

First, a user turns on the power of the ink jet printer 100, then pulls out the paper tray 150 from the tray inlet/outlet 112 to put a predetermined number of sheets of paper P therein, and pushes the paper tray 150 in the tray inlet/outlet 112, thus loading the paper tray 150. Then, in the ink jet printer 100, the energizing force of the spring 151 causes the paper support 152 to raise one end portion of the paper P, thus pushing the one end portion of the paper P against the paper supply roller 141. Then, in the ink jet printer 100, the driving of the paper supply motor 142 rotationally drives the paper supply roller 141, thus feeding one sheet of paper P from the paper tray 150 to the carriage rollers 132.

Subsequently, in the ink jet printer 100, the driving of the carriage motor 134 rotationally drives the carriage rollers 132, 133, and the pair of carriage rollers 132 catch the paper P fed from the paper tray 150, thus feeding the paper to the carriage guide 131. Then, in the ink jet printer 100, the line head 120 operates at predetermined timing to eject ink drops from the nozzles and drop the ink drops on the paper P, thus recording information including a character and/or an image in the form of dots on the paper P. Then, in the ink jet printer 100, the pair of carriage rollers 133 catch the paper P fed along the carriage guide 131, thus ejecting the paper P from the paper ejection port 111.

The ink jet printer 100 repeats such an operation to generate prints until the recording is completed.

The electric circuit section 160 in the ink jet printer 100 will now be described.

Figure 3:
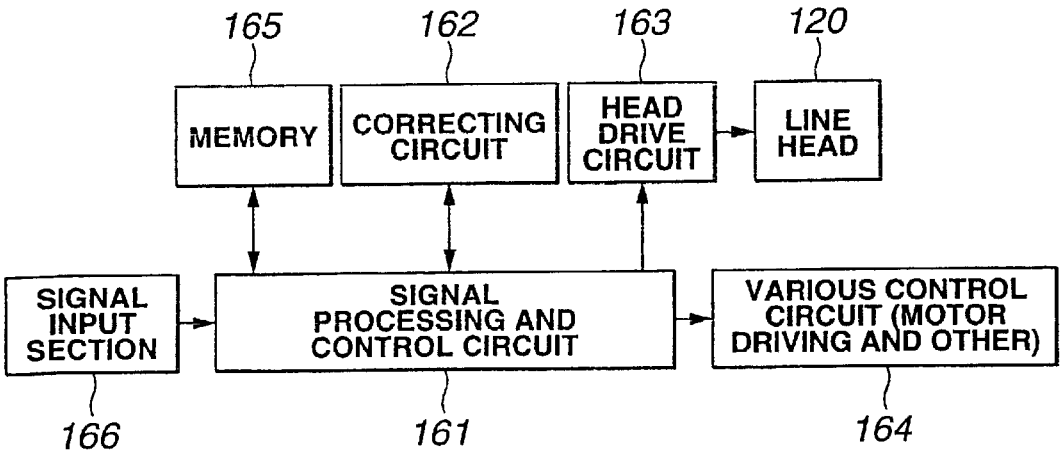
FIG. 3 is a block diagram showing the structure of a recording and control system of an electric circuit section in the ink jet printer.

As shown in FIG. 3, the electric circuit section 160 has the following constituent elements: a signal processing and control circuit 161 for carrying out signal processing and control processing based on software, for example, as the configuration of a CPU (central processing unit) and a DSP (digital signal processor); a correcting circuit 162 in which predetermined correction data is stored in a so-called ROM (read only memory) map system; a head drive circuit 163 for driving the line head 120; a various control circuit 164 for controlling the driving of the carriage motor 134 and the paper supply motor 142, and other operations; a memory 165 such as a line buffer memory or a one-screen memory; and a signal input section 166 to which signals of recording data or the like are inputted. The signal processing and control circuit 161 is connected with the correcting circuit 162, the head drive circuit 163, the various control circuit 164 and the memory 165.

In the electric circuit section 160, when signals of recording data or the like are inputted to the signal processing and control circuit 161 via the signal input section 166, these signals arranged in the recording order by the signal processing and control circuit 161 and are supplied to the correcting circuit 162. The correction circuit 162 carries out correction processing such as so-called gamma correction, color correction, and correction of nozzle dispersion. The signals of recording data or the like after the correction are taken out by the signal processing and control circuit 161 in accordance with external conditions such as nozzle number, temperature, and input signals. Then, in the electric circuit section 160, the signals taken out by the signal processing and control circuit 161 are supplied as driving signals to the head drive circuit 163 and the various control circuit 164. The electric circuit section 160 causes the head drive circuit 163 to control the driving of the line head 120 in accordance with the driving signal. The electric circuit section 160 causes the various control circuit 164 to control the driving of the carriage motor 134 and the paper supply motor 142 in accordance with the driving signal and also to control the driving in the cleaning processing of the line head 120. In the electric circuit section 160, when necessary, the signals of recording data or the like are temporarily recorded in the memory 165 and taken out by the signal processing and control circuit 161.

Figure 4:
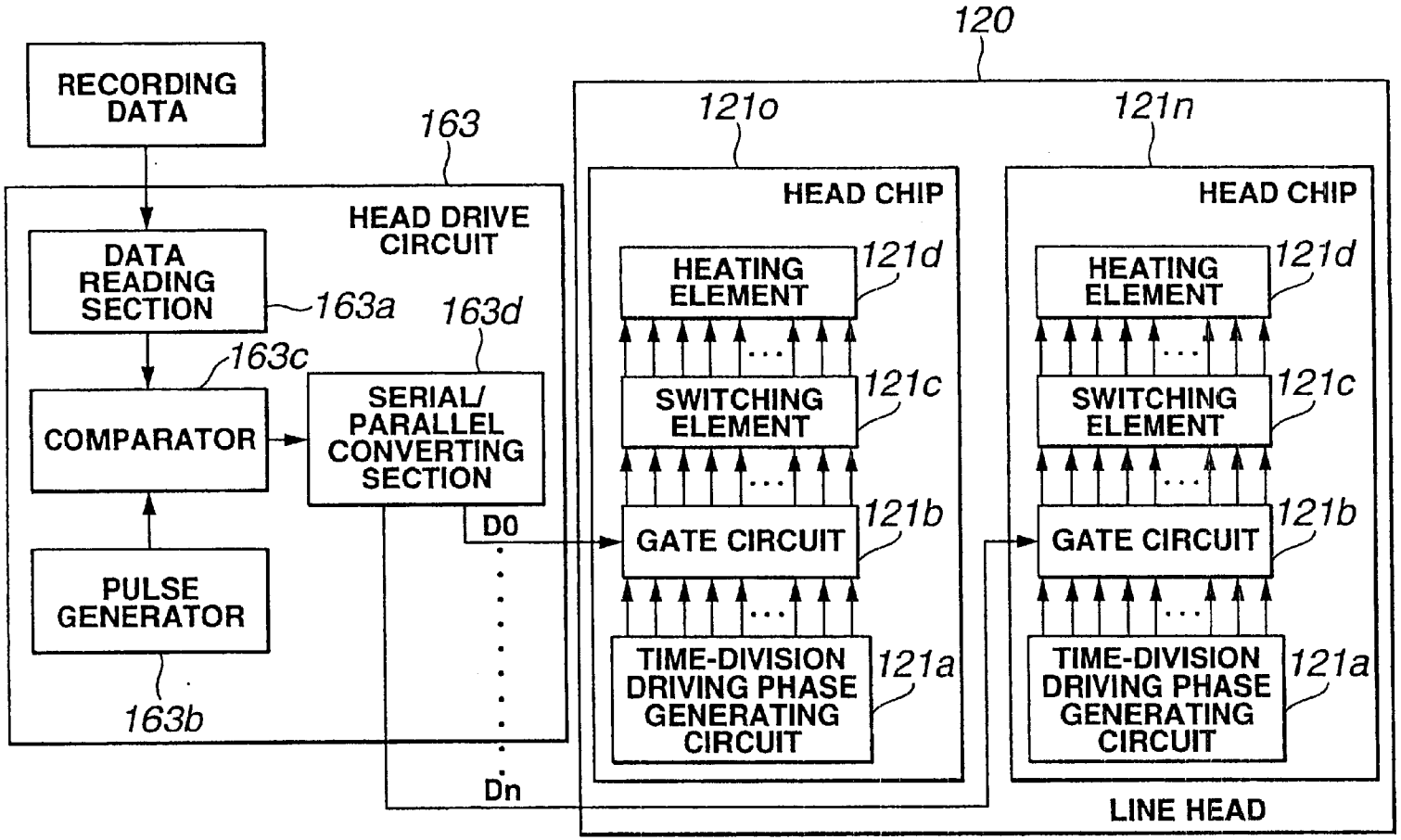
FIG. 4 is a block diagram showing the detailed structure of a head drive circuit shown in FIG. 3 and a line head.

FIG. 4 shows the details of the structures of the head drive circuit 163 and the line head 120.

As shown in FIG. 4, the head drive circuit 163 has a structure adapted for carrying out PNM and later-described time-division driving, and has a data reading section 163*a*, a pulse generator 163*b*, a comparator 163*c* and a serial/parallel converting section 163*d*.

The data reading section 163*a* reads out data indicating information about the pulse number for carrying out PNM, from the driving signal supplied from the signal processing and control circuit 161. The data reading section 163*a* supplies the read-out data to the comparator 163*c*.

Figure 5:
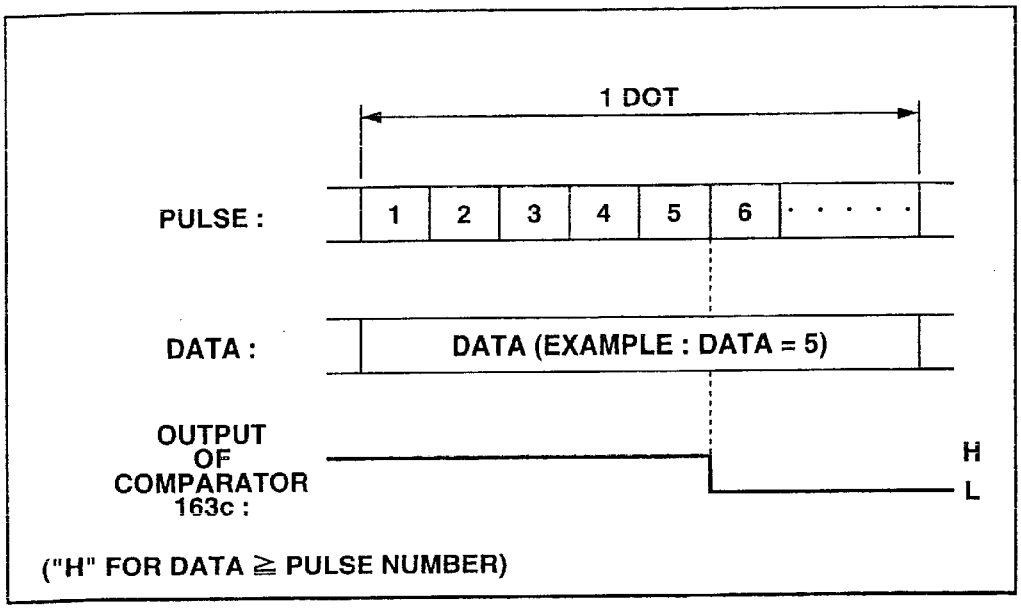
FIG. 5 illustrates PNM (pulse number modulation) processing by the head drive circuit shown in FIG. 4, and shows the relation between a pulse generated by a pulse generator provided in the head drive circuit, data read out by a data reading section provided in the head drive circuit, and a signal outputted from a comparator provided in the head drive circuit.

The pulse generator 163*b* generates a predetermined number of pulses for carrying out PNM, at predetermined intervals, as shown in FIG. 5. For example, the pulse generator 163*b* constantly spontaneously generates eight pulses at predetermined intervals. That is, the head drive circuit 163 determines the number of ink drops to be ejected and determines the arrangement of dots for each gradation, on the basis of the pulses generated by the pulse generator 163*b*. The pulse generator 163*b* supplies the generated pulses to the comparator 163*c*.

The comparator 163*c* receives the data read out from the memory 165 via the signal processing and control circuit 161 by the data reading section 163*a* and also receives the pulse number generated by the pulse generator 163*b*. The comparator 163*c* compares the data with the pulse number. If the result of comparison shows that the data is not less than the pulse number, the comparator 163*c* supplies a high signal "H" to the serial/parallel converting section 163*d*, as shown in FIG. 5. For example, if the data is "5" and the pulse number generated by pulse generator 163*b* is "1 to 5," the comparator 163*c* outputs a high signal "H." If the pulse number is "6" or larger, the comparator 163*c* outputs a low signal "L."

The serial/parallel converting section 163*d*, which will be later described in detail, is provided since the head chips of the line head 120 of the number corresponding to the number of divisions of time-division driving are provided. The serial/parallel converting section 163*d* performs parallel conversion on the serial data supplied from the comparator 163*c* and supplies a plurality of data D0, . . . , Dn obtained by parallel conversion to the head chips of the line head 120, respectively.

The line head 120 has a plurality of head chips $\mathbf{121}_0$, . . . , $\mathbf{121}_n$, as shown in FIG. 4. Each head chip 121 constitutes one block in time-division driving, and a plurality of parts for constituting the one block are tiled within the head chip. Specifically, each of the head chips $\mathbf{121}_0$, . . . , $\mathbf{121}_n$ has a time-division driving phase generating circuit 121*a*, agate circuit 121*b*, a switching element 121*c*, and heating elements 121*d*.

The time-division driving phase generating circuit 121*a* has outputs of the same number as the total number of phases, that is, the number of nozzles constituting one block. The time-division driving phase generating circuit 121*a* sequentially generates a phase signal for each phase and supplies the phase signal to the gate circuit 121*b*.

The gate circuit 121*b* is a so-called AND gate, which takes the logical product of the phase signal supplied from the time-division driving phase generating circuit 121*a* and the data supplied from the serial/parallel converting section 163*d*. If both the phase signal supplied from the time-division driving phase generating circuit 121*a* and the data supplied from the serial/parallel converting section 163*d* are high signals "H," the gate circuit 121*b* turns the switching element 121*c* ON.

The switching element 121*c* is adapted for switching whether to drive the beating elements 121*d* to eject ink drops from the nozzles. The ON/OFF control of the switching element 121*c* is carried out by the gate circuit 121*b*.

The heating elements 121*d* are driven to heat and causes ejection of ink drops from the corresponding nozzles, when the switching element 121*c* is in the ON state.

Since the ink jet printer 100 employs the thermal system, the above-described time-division driving is carried out in order to restrain the dissipation power. To carry out time-division driving and PNM, the ink jet printer 100 has the following structure to operate.

Figure 6:
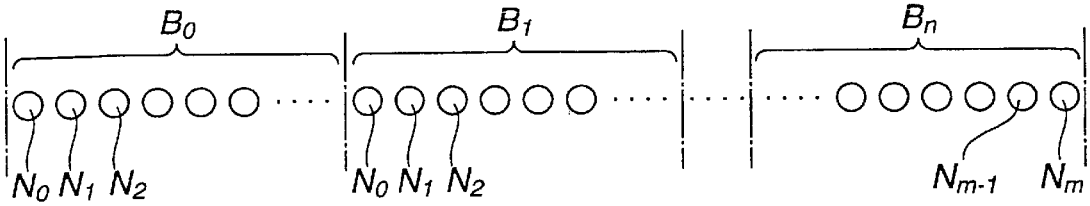
FIG. 6 is a schematic view showing the arrangement of nozzles in the line head, in which every predetermined number of nozzles, of a plurality of nozzles, are sectioned to constitute a block.

Specifically, in the ink jet printer 100, as schematically shown in FIG. 6, a plurality of nozzles are arrayed substantially on a straight line in the line head 120 and every predetermined number of nozzles of these plural nozzles are sectioned to form the blocks corresponding to the number of divisions of time-division driving, that is, the head chips 121. In FIG. 6, the blocks are denoted by $B_0$, $B_1$, . . . , $B_n$ from left, and the nozzles in each block are denoted by $N_0$, $N_1$, $N_2$, . . . , $N_{m-1}$, $N_m$. The phase indicates the position of the nozzles in each block. For example, the nozzle $N_0$ in the block $B_0$, the nozzle $N_0$ in the block $B_1$, and the nozzle $N_0$ in the block $B_n$ are of the same phase.

Figure 7:
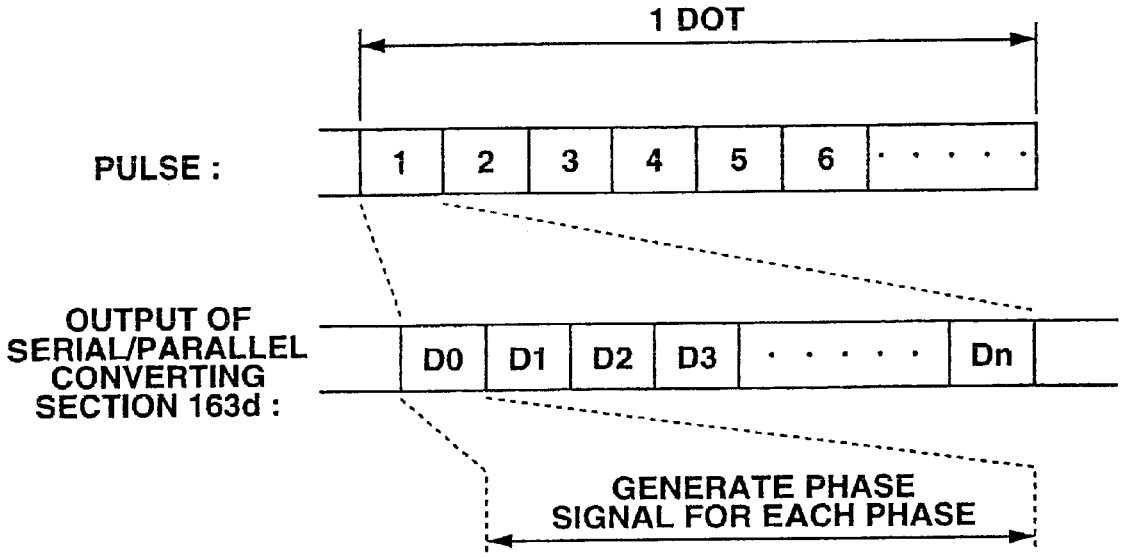
FIG. 7 illustrates PNM processing by the head drive circuit shown in FIG. 4 and the operation at a serial/parallel converting section provided in the head drive circuit.

In the ink jet printer 100 thus constituted, the serial/parallel converting section 163*d* generates data D0, . . . , Dn corresponding to the respective blocks $B_0$, $B_1$, . . . , $B_n$ for each pulse generated by the pulse generator 163*a*, and supplies these data D0, . . . , Dn to the blocks $B_0$, $B_1$, . . . , $B_n$, respectively, as shown in FIG. 7.

In response to this, in the ink jet printer 100, the time-division driving phase generating circuit 121*a* sequentially generates a phase signal for each phase, thus causing ejection or non-ejection of an ink drop for one pulse, that is, a single ink drop, with respect to all the nozzles N. In this case, the time-division driving phase generating circuit 121*a* sequentially generates the phase signal for each phase so that the time-division driving phase generating circuit 121*a* first carries out the processing to drive the heating elements 121*d* corresponding to the nozzles $N_0$ in the blocks $B_0$, $B_1$, . . . , $B_n$, and then carries out the processing to drive the heating elements 121*d* corresponding to the nozzles $N_1$ in the blocks $B_0$, $B_1$, . . . , $B_n$.

The ink jet printer 100 repeats such an operation for each pulse generated by the pulse generator 163*a*, thus forming one dot having a diameter corresponding to the pulse number.

Thus, the ink jet printer 100 can simultaneously realize PNM and time-division driving. The PNM operation in the ink jet printer 100 will be later described further in detail.

The structure of the line head 120 in the ink jet printer 100 will now be described in detail.

Figure 8A:
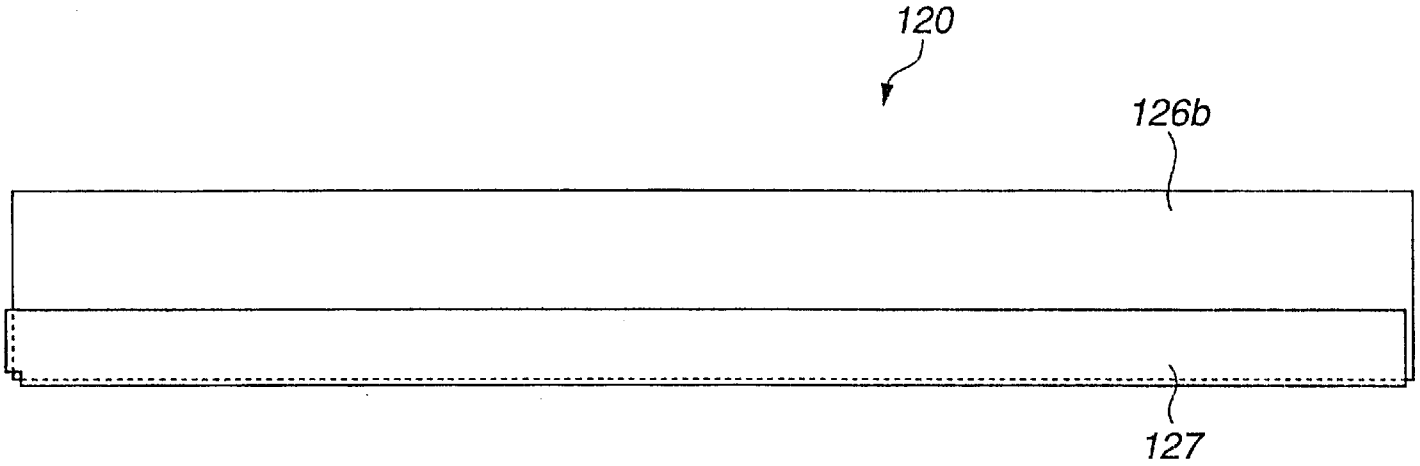
FIG. 8A is an outer side view for explaining the structure of the line head for one color.
Figure 8B:
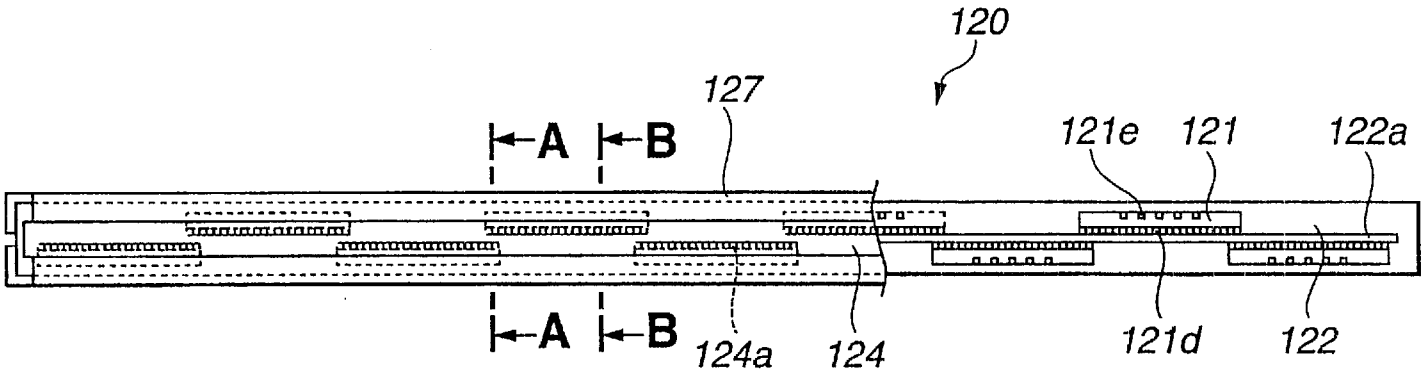
FIG. 8B is an outer bottom view for explaining the structure of the line head for one color.
Figure 9:
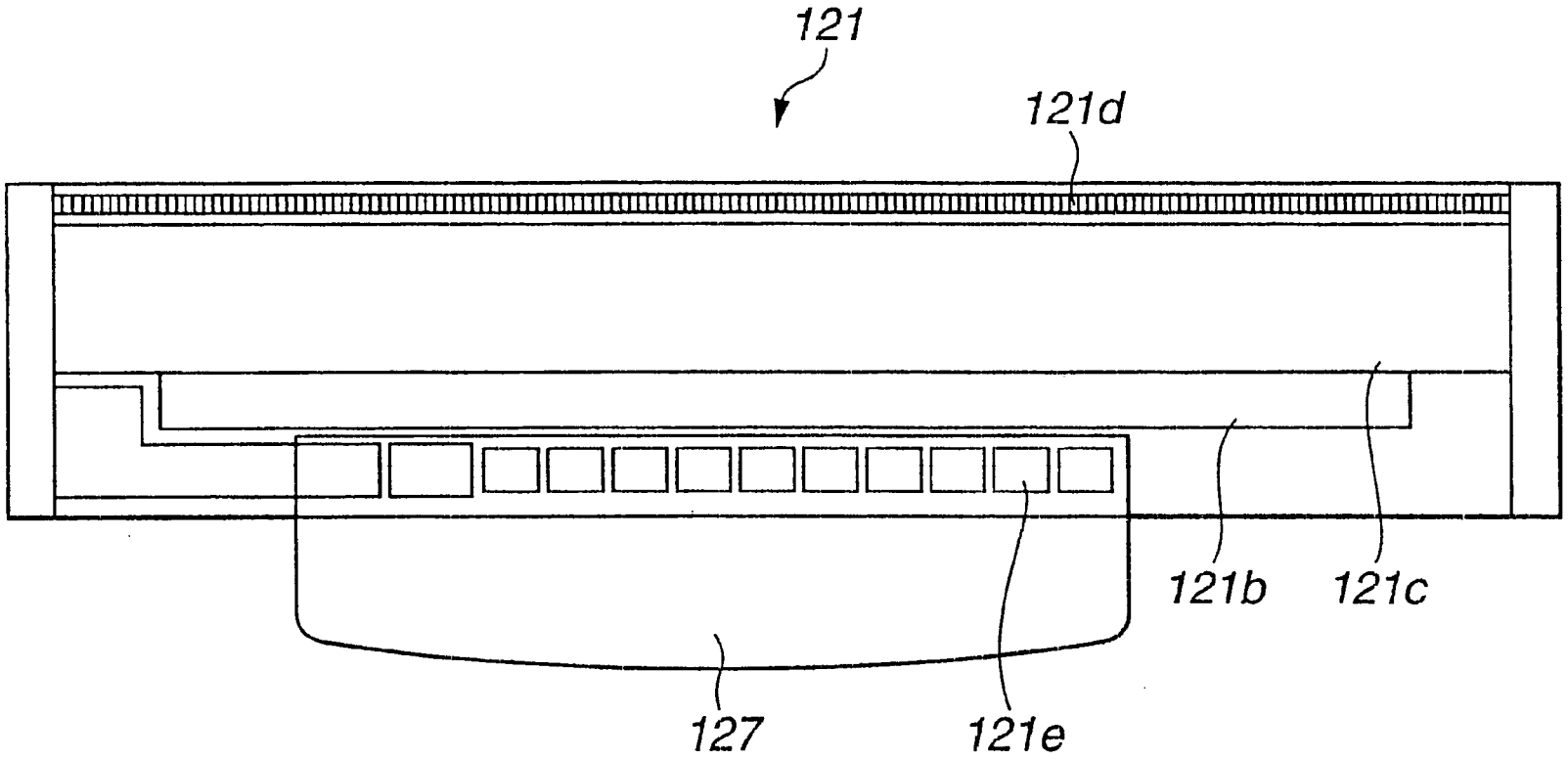
FIG. 9 illustrates the detailed structure of a head chip.
Figure 10A:
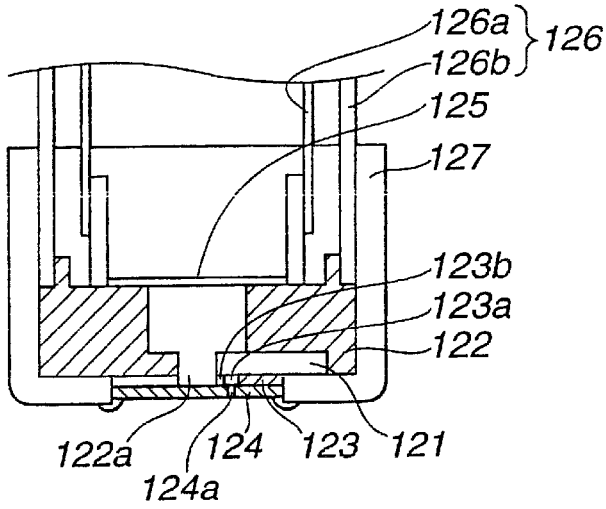
FIG. 10A is a side view showing a cross section along a line A—A in the line head of FIG. 8B.
Figure 10B:
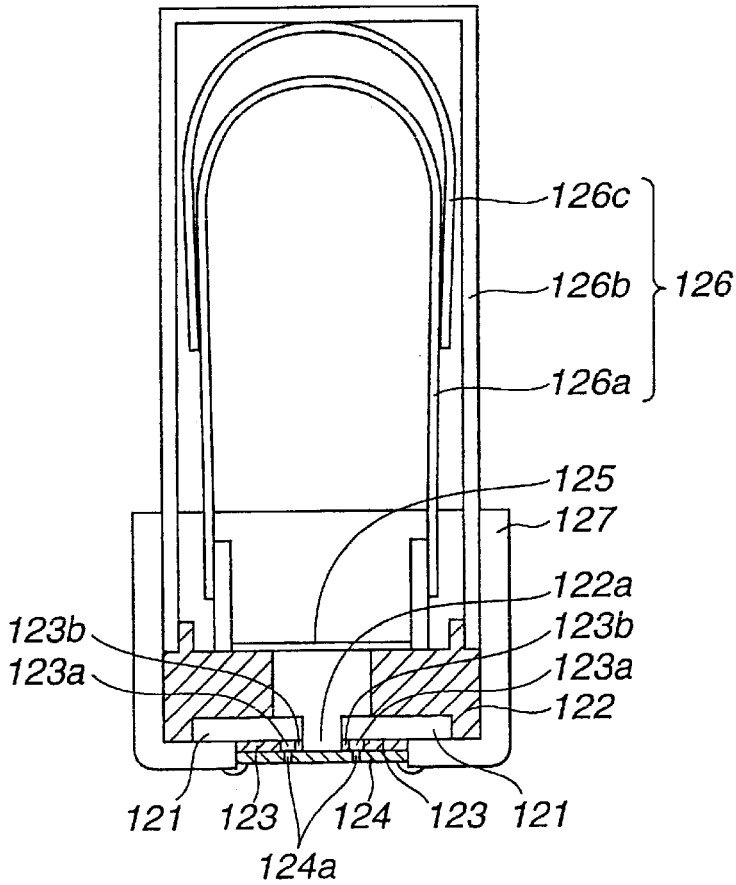
FIG. 10B is a side view showing a cross section along a line B—B in the line head of FIG. 8B.
Figure 11:
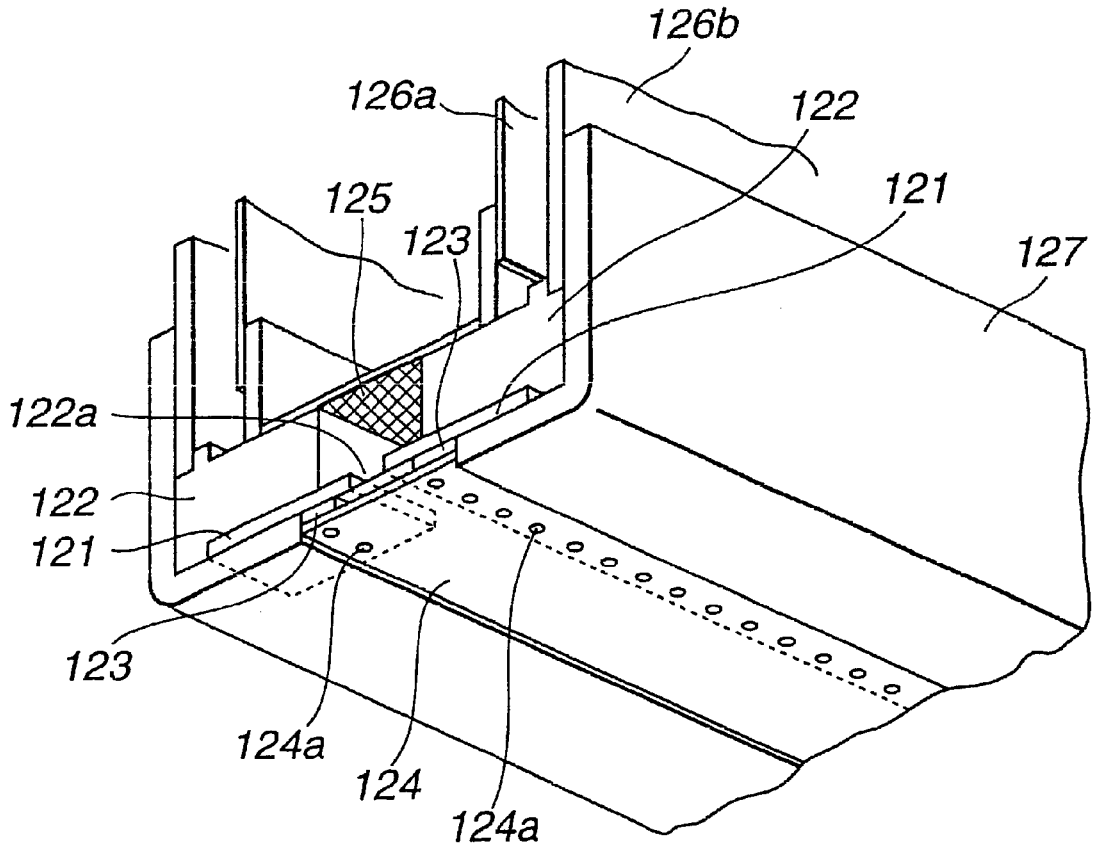
FIG. 11 is a partial perspective view showing the line head of FIGS. 8A and 8B from the bottom side.
Figure 12:
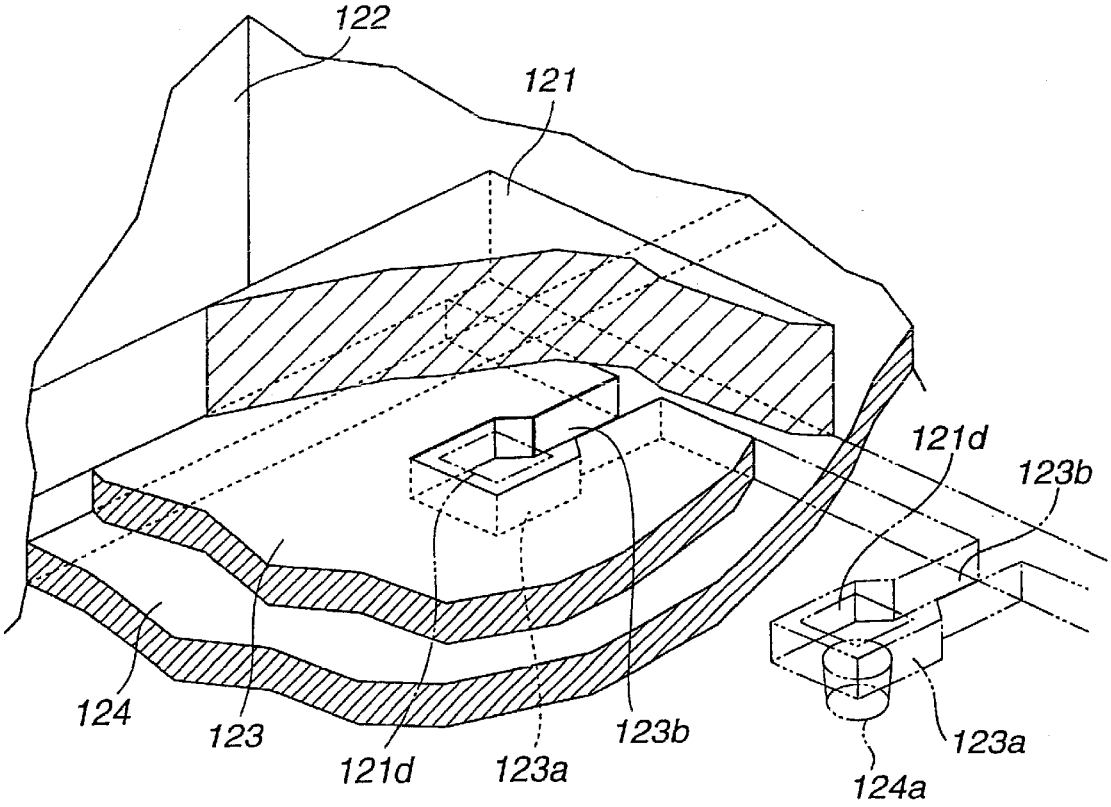
FIG. 12 is a partial perspective view showing the detailed structure near the nozzles in the line head of FIGS. 8A and 8B and showing the line head from the head chip side.

FIGS. 8A to 12 show the structure of the line head 120 for one color in the ink jet printer 100. FIG. 8A is a side view showing the appearance of the line head 120. FIG. 8B is a bottom view showing the appearance of the line head 120. FIG. 9 shows the detailed structure of the head chip 121. FIG. 10A is a side view showing the cross section along the line A—A in the line head 120 shown in FIG. 8B. FIG. 10B is a side view showing the cross section along the line B—B in the line head shown in FIG. 8B. FIG. 11 is a partial perspective view of the line head 120 shown in FIGS. 8A and 8B, as viewed from the bottom side. FIG. 12 is a partial perspective view of the line head 120 as viewed from the side of the head chip 121, in order to show the detailed structure near the nozzles in the line head 120 shown in FIGS. 8A and 8B.

The line head 120 is covered by an outer casing 126*b* constituting a later-described ink tank 126, and the lower part of the line head 120 is covered by a later-described electric wiring 127, as shown in FIG. 8A.

In the line head 120, a slit-shaped ink supply port 122*a* is opened in a central portion of a linear head frame 122, as shown in FIG. 8B. A plurality of head chips 121 made of Si substrates are provided on one surface of the head frame 122. The head chips 121 are arrayed in a zigzag manner on both sides of the ink supply port 122*a* opened in the head frame 122, in order to make the head long. Each of the head chips 121 is constituted by arranging the above-described plurality of heating elements 121*d* in a line on the side of the ink supply port 122*a* and arranging connection terminals 121*e* in a line corresponding to the heating elements 121*d*, on the side opposite to the ink supply port 122*a*, that is, on the side of the outer casing 126*b*, as shown in FIGS. 8B and 9.

In the example of FIG. 9, the heating elements 121*a* are arrayed at 600 dpi (dots per inch). Moreover, in the head chip 121, the gate circuit 121*b* and the switching element 121*c* for the head chip 121 (heating elements 121*d* ) to carry out time-division driving are provided between the beating elements 121*d* and the connection terminals 121*e*.

Below the head chips 121 is a nozzle plate 124 having a plurality of nozzles 124*a*, with a member 123 provided between the head chips 121 and the nozzle plate 124, as shown in FIGS. 10A and 12. The member 123 is provided to form a plurality of liquid chambers 123*a* for storing ink and a plurality of flow paths 123*b* for causing the ink to flow to the liquid chambers 123*a*. The member 123 is made of a photosensitive resin such as a so-called dry film photoresist and is provided so that the heating elements 121*d* provided on the head chip 121 are correspondingly situated above the liquid chambers 123*a*, shown in detail in FIG. 12. Moreover, the member 123 is formed so that the flow paths 123*b* extend from the liquid chambers 123*a* to the end portions of the head chips 121, that is, to the end portions on the side of the central part of the line head 120, as shown in FIG. 10B.

The nozzle plate 124 is formed by electroforming nickel and is anticorrosive-plated with gold or palladium for preventing corrosion due to ink. The nozzle plate 124 is formed to close the ink supply port 122*a*, which is a space formed by the head chip 121, the head frame 122, the member 123 and a later-described filter 125, as shown in FIGS. 10A, 10B and 11. Moreover, the nozzle plate 124 is formed so that the nozzles 124*a* correspond to the heating elements 121*d* one to one via the respective liquid chambers 123*a*, as shown in FIG. 12. That is, each liquid chamber 123*a* is continued to the flow path 123*b* formed in the member 123 and to the nozzle 124*a* formed in the nozzle plate 124.

On the other side of the head frame 122, the ink tank 126 is provided with a filter 125 arranged between the head frame 122 and the ink tank 126, as shown in FIGS. 10A and 10B. The filter 125 is provided to close the ink supply port 122*a* and serves to prevent dust and flocculated ink ingredients from entering the nozzle 124*a* from the ink tank 126.

The ink tank 126 has a dual structure made up of a bag 126*a* and an outer casing 126*b*, as shown in FIG. 10B. A spring member 126*c* for energizing the bag 126*a* to expand outward is provided between the bag 126*a* and the outer casing 126*b*. Thus, in the line head 120, a negative pressure is applied on the ink in the ink tank 126 and spontaneous leakage of the ink from the nozzle 124*a* can be prevented. In the line head 120, since the negative pressure is set to be smaller than the capillary force of the nozzle 124*a*, the ink can be prevented from being drawn into the nozzle 124*a*.

Moreover, in the line head 120, an area including a part of the end surfaces of the head chips 121, the outer circumferential surface of the head frame 122 and the outer circumferential surface of the ink tank 126 is covered by the electric wiring 127 made of a so-called FPC (flexible printed board). The electric wiring 127 is provided for supplying electric power and electric signals to the head chips 121 and is connected to the connection terminals 121*e* of the head chips 121.

In the ink jet printer 100 having the line head 120 as described above, ink is supplied from the ink tank 126 to the ink supply port 122*a*, then passes through the flow paths 123*b*, and is supplied to the liquid chambers 123*a*. Each of the nozzles 124*a* has such a cross section that the circular distal end of a cone is cut off on a plane parallel to the bottom surface, as shown in FIG. 12, and a so-called meniscus of the ink surface with its central portion recessed by the negative pressure on the ink is formed at the distal end of the nozzle 124*a*. In the ink jet printer 100, when a driving voltage is supplied to the heating elements 121*d* and bubbles are generated on the surfaces of the heating elements 121*d*, ink particles are ejected from the nozzles 124*a*.

In the ink jet printer 100, since the head chips 121 are arranged in a zigzag manner as described above, the plurality of nozzles 124*a* (hereinafter referred to as nozzle group) corresponding to a single head chip 121 are similarly arranged in a zigzag manner.

Although there are conventional head chips arranged in a zigzag manner, these head chips are simply shifted from each other in parallel and therefore two adjacent nozzle groups $NG_A$, $NG_B$ are simply shifted from each other in parallel, as shown in FIG. 13. In the ink jet printer using this arrangement, unevenness in the quantity of ejection of ink among the head chips and errors of ink dropping positions on the paper may take place because of unevenness in the characteristics of the head chips and positioning errors.

In the ink jet printer, if recording is made on the paper when there is unevenness in the quantity of ejection of ink, a change point (line) of the quantity of ejection, that is, of the diameter (print density) of dots, is generated in an area on the paper corresponding to the joint of the head chips. Specifically, if the ink jet printer uses head chips in which a nozzle group consisting of nozzles with a large quantity of ejection and a nozzle group consisting of nozzles with a small quantity of ejection are adjacent to each other, a change point (line) V of the diameter of dots is generated on the boundary between a dot group $DG_A$ recorded by the nozzle group consisting of the nozzles with a large quantity of ejection and a dot group $DG_B$ recorded by the nozzle group consisting of the nozzles with a small quantity ejection, as shown in FIG. 14A. Such a change point (line) of the dots causes a longitudinal stripe in the paper feed direction, that is, a so-called banding noise.

On the other hand, in the ink jet printer, if recording is made on the paper when there is an error of the ink dropping position on the paper, an overlap of dots, a gap between dots, or a step between dots is generated in an area on the paper corresponding to the joint of the head chips. Specifically, an overlap O of dots as shown in FIG. 14B, a gap C between dots as shown in FIG. 14C, or a step L between dots as shown in FIG. 14D is generated on the boundary between a dot group $DG_A$ recorded by one nozzle group and a dot group $DG_B$ recorded by another nozzle group. These overlap of dots, gap between dots, and step between dots also cause a longitudinal stripe in the paper feed direction.

Figure 15:
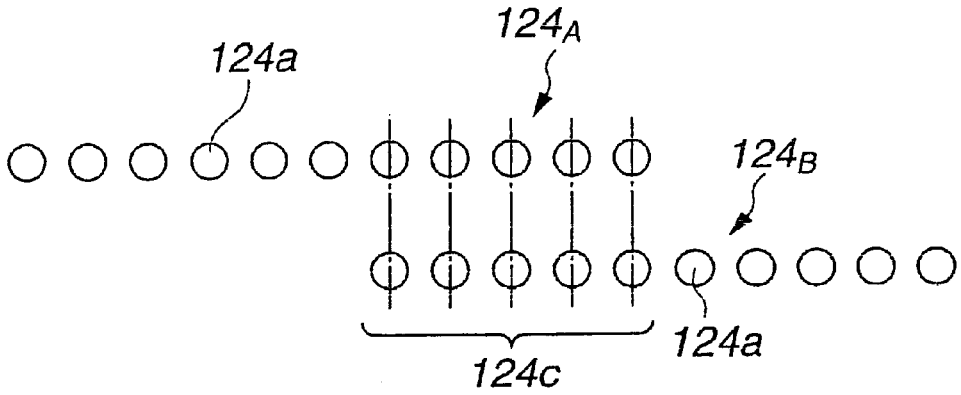
FIG. 15 shows the arrangement of two adjacent groups of nozzles in the line head shown in FIGS. 8A and 8B.

Thus, in the ink jet printer 100, an overlap part $124_c$ is provided at the joint between a nozzle group $124_A$ and a nozzle group $124_B$ corresponding to the adjacent head chips 121, both nozzle groups consisting of a plurality of nozzles 124*a*, as shown in FIG. 15. That is, in the ink jet printer 100, of the nozzle groups corresponding to the adjacent head chips 121 arranged in a zigzag manner, a predetermined number of nozzles from right in the nozzle group $\mathbf{124}_A$ on the left side and the same number of nozzles from left in the nozzle group $\mathbf{124}_B$ on the right side are arranged so that their centerlines coincide with each other, and this portion of overlapping nozzles is provided as the overlap part $\mathbf{124}_C$.

Figure 16:
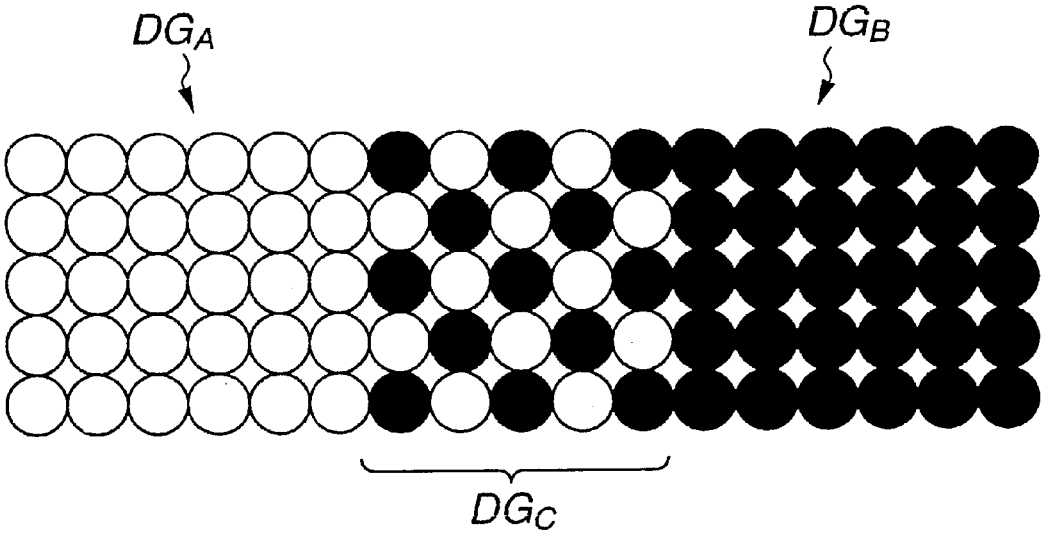
FIG. 16 shows the state of groups of dots recorded by using the line head shown in FIGS. 8A and 8B.

In the overlap part $\mathbf{124}_C$, the nozzles 124*a* constituting the one nozzle group $\mathbf{124}_A$ and the nozzles 124*a* constituting the other nozzle group $\mathbf{124}_B$ are used to alternately eject ink, for example, both in the lateral direction and in the longitudinal direction. Thus, a dot groups $DG_C$ corresponding to the overlap part $\mathbf{124}_C$ can be formed on the boundary between the dot group $DG_A$ recorded by the one nozzle group $\mathbf{124}_A$, indicated by white circles, and the dot groups $DG_B$ recorded by the other nozzle group $\mathbf{124}_B$, indicated by block circles, as shown in FIG. 16. In the dot group $DG_C$, the dots recorded by the nozzle group $\mathbf{124}_A$ and the dots recorded by the other nozzle group $\mathbf{124}_B$ are alternately arranged. Therefore, in the ink jet printer 100, the generation of the above-described longitudinal stripe, that is, the banding noise, can be reduced or moderated.

The PNM operation in the ink jet printer 100 will now be described in detail.

PNM is a technique for modulating the diameter of dots by the number of ink drops continuously ejected in one pixel (pulse number), thus carrying out gray scale printing.

Figure 17:
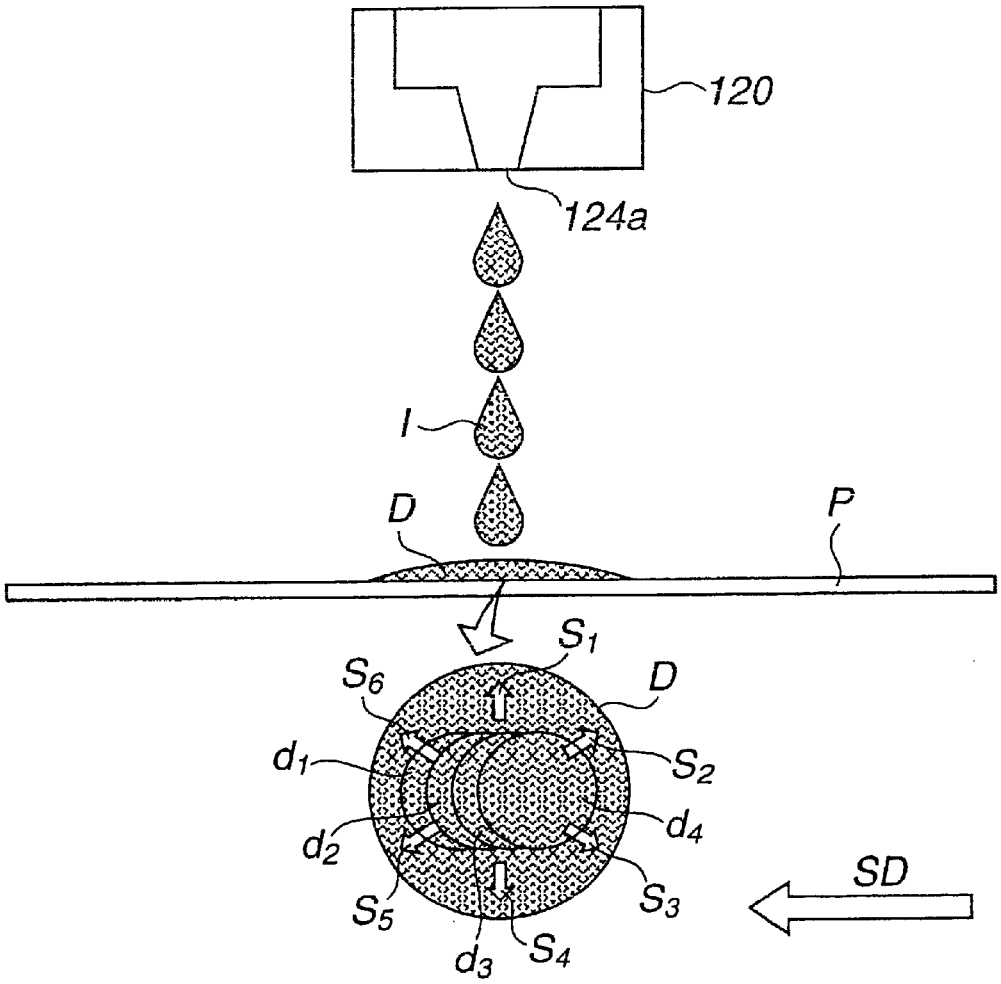
FIG. 17 is a conceptual view for explaining the principle of PNM.

FIG. 17 shows a conceptual view for explaining the principle of PNM.

In carrying out PNM, the ink jet printer 100 ejects one or a plurality of ink drops I from the nozzles 124*a* onto paper P, thus recording a dot D thereon. When ejecting a plurality of ink drops I, the ink jet printer 100 modulates the diameter of the dot D by dropping the next ink drop I onto the paper P before the first ink drop I dropped on the paper P is dried. That is, the inkjet printer 100 modulates the diameter of the dot D, utilizing the spread of dots d, formed by the respective ink drops I dropped on the paper P correspondingly to each pulse, in all the directions of 360° as indicated by arrows $S_1$, $S_2$, $S_3$, $S_4$, $S_5$, $S_6$ in FIG. 17 before drying. In this example, the ink jet printer 100 drops the next ink drop I on the paper P before the first dot $d_1$ dropped on the paper P is dried, and thus recording dots $d_2$, $d_3$, $d_4$, . . . In this case, the drying of the ink means that the spread of the ink does not exceed an allowable range. The ink jet printer 100 modulates the diameter of the dot D in the state where the plurality of ink drops I spread in a united manner. In this case, since the paper P continuously moves in a direction indicated by an arrow SD in FIG. 17 relatively to the line head 120, the dots $d_1$, $d_2$, $d_3$, $d_4$, . . . recorded on the paper P are slightly shifted in the opposite direction of the feed direction of the paper P.

If the cycle of dropping the ink drop I onto the paper P is shorter than a predetermined cycle, the ink isotropically spreads and therefore the dot D presents a shape similar to a true circle. If the cycle of dropping the ink drop I onto the paper P is longer, the dot D presents a substantially elliptic shape which is long in the feed direction of the paper P. The relation between the cycle of dropping the ink drop I onto the paper P and the aspect ratio of the diameter of the dot D changes, depending on the properties of the ink and the paper P such as the absorption of the ink to the paper P. The ink jet printer 100 determines the cycle of dropping the ink drop I onto the paper P on the basis of experimental values and in accordance with desired use conditions, for example, to expand the cycle for sufficiently increasing the diameter of the dot D. The ink jet printer 100 employs, for example, approximately 100 milliseconds or less as the cycle of dropping the ink drop I onto the paper P.

The line head 120 in the ink jet printer 100 has four colors such as CMYK as described above. When mixing ink drops of a plurality of colors, the ink jet printer 100 drops an ink drop of one color on the paper P and then drops the next ink drop of a different color after the first dropped and recorded dot is dried. If the time until dropping the next ink drop of the different color is short, the spread of the ink called color bleed occurs, causing deterioration of the picture quality. In this case, the ink jet printer 100 preferably drops an ink drop of black (K) on the paper P lastly. This is because the black ink usually does not dry fast. The ink jet printer 100 can provide a sharp recorded image by lastly dropping the black ink on the paper P. Moreover, the ink jet printer 100 can provide a more natural image by first dropping a yellow (Y) ink, which is bright in contrast to the black ink, on the paper P.

An ordinary serial head, which does not carry out the one-path recording, can increase the number of gradations by overprinting a plurality of times at the same position in scanning back and forth on the paper, but has a problem of a long recording time corresponding to the number of times of overprinting. On the other hand, a line head can complete recording by scanning once and therefore can reduce the recording time remarkably. If recording is carried out using the line head with a resolution of 600 dpi and a pixel (line) recording frequency of 10 kHz, the time required for scanning the longitudinal direction of paper of A4 size is approximately 0.7 second per color in the case where one ink drop is ejected.

However, in consideration of the ink drying time, a recording time of approximately 10 seconds is considered appropriate with the line head. In this case, the pixel (line) recording frequencies for resolutions of 300 dpi, 600 dpi, and 1200 dpi are approximately 350 Hz, 700 Hz, and 1.4 kHz, respectively. Therefore, an ink jet printer using a line head can carry out PNM within the pixel (line) recording frequency, unlike an ink jet printer using an ordinary serial head. Thus, PNM is considered as a gradation expressing method suitable for the line head.

The quality of a recorded image printed by the ink jet printer 100 using PNM will now be described.

To improve the picture quality, the resolution of the recorded image should be raised for printing. However, it is desired to minimize the number of nozzles in view of the manufacturing cost and reliability, thus raising a problem of designing that the resolution of the recorded image cannot be raised.

Thus, by using PNM for printing, the ink jet printer 100 can express gradation within a pixel and can provide a recorded image of high definition with less rough or granular appearance even when a lower resolution is set than in binary recording. Moreover, the ink jet printer 100 supplements the number of gradations based on PNM determined by the maximum pulse number in forming one dot and therefore can combine PNM with so-called dot density modulation. In this case, since multi-level recording within a pixel can be realized by using PNM, the ink jet printer 100 can carry out not only binary but also multi-level dither processing and error diffusion processing, and can carry out smoother gray scale printing of high definition.

The measures to cope with an error in the ink dropping position on the paper and unevenness in the quantity of ejection of ink among the nozzles in the ink jet printer 100 using PNM will now be described. In the following description, the ink jet printer 100 of design specifications shown in Table 1 is used.

TABLE 1

| | |
|---|---|
| Maximum recording width | 8.5 inches |
| Resolution | 600 dpi |
| Number of nozzles per color | 5100 |
| Target quantity of ejection of each nozzle per pulse | 3 pl |
| Maximum pulse number | 8 pulses |
| Number of levels | 9 levels |
| Ejection frequency | 4.8 kHz |
| Line recording frequency | 600 Hz |

With these design specifications, the ink jet printer 100 ejects ink drops for 8 pulses at the maximum to pixels of 600 dpi. One pulse is equivalent to ink drops for 3 pl and ink drops for 24 pl at the maximum are ejected for one pixel. The diameter of a dot in this case is approximately 40 $\mu$m for one pulse on ink jet glossy paper on the market, used for evaluation. The ideal dot diameter is $\sqrt{2}$ times the obtained value, that is, approximately 60 $\mu$m. The ink jet printer 100 assumes a position for forming one dot by one ink drop on the paper as a virtual lattice point on the paper, and ideally, the ink jet printer 100 forms dots at and around the lattice points. The ink jet printer 100 provides a dot deviation margin of 20 $\mu$m on the paper as an allowable range of deviation of dots from the lattice points. With this margin, the ink jet printer 100 copes with the problem of an error of the ink dropping position on the paper.

To provide a recorded image of high definition, the unevenness in the characteristics of the nozzles must be minimized. As a method for reducing the unevenness in the quantity of ejection among the nozzles, that is, the unevenness in the print density, it is considered to change the electric power applied to heating element and the pulse width, for each nozzle.

Figure 18:
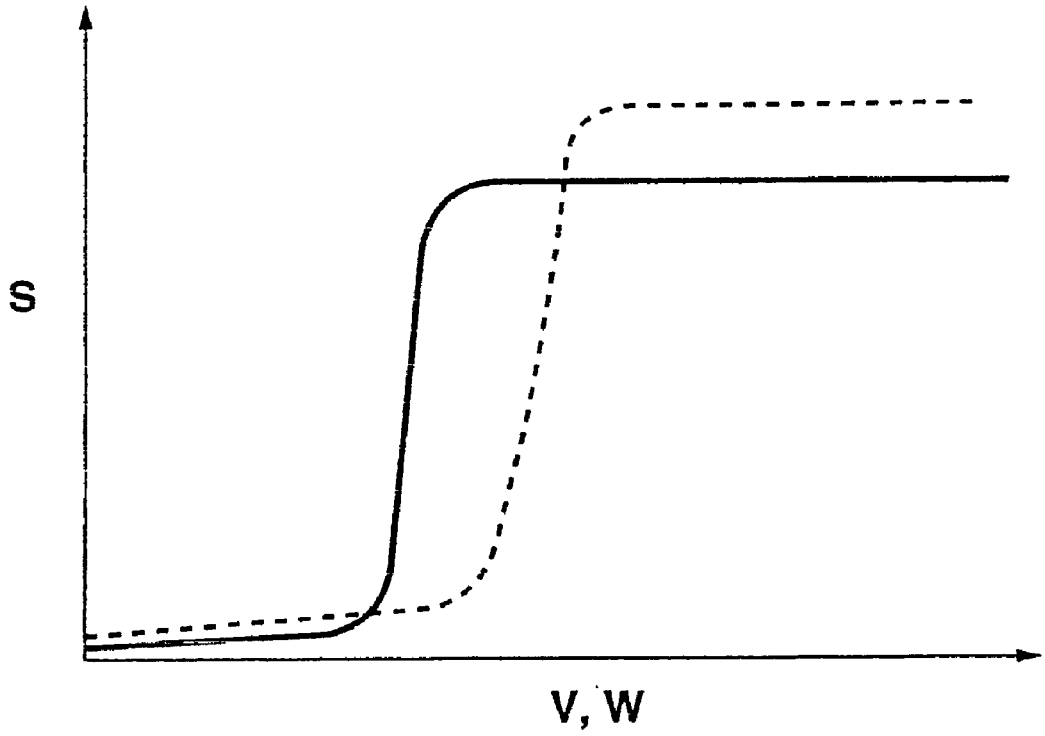
FIG. 18 shows the relation between the quantity of ink drops ejected from the nozzles and the power applied to the heating elements or the pulse duration.

However, the quantity of ejection S of ink drops from the nozzles usually does not monotonously increase along with the increase in the power V applied to the heating elements, but tends to suddenly increase when the power exceeds a predetermined power value, as indicated by a solid line in FIG. 18. The quantity of ejection S of ink drops in relation to the pulse width W usually presents the same tendency, as indicated by a broken line in FIG. 18. That is, in the ink jet printer, it is difficult to control the quantity of ejection of ink drops by the power applied to the heating elements and the pulse width.

Thus, the ink jet printer 100 carries out correction of unevenness in the print density, using PNM. Specifically, when producing a recorded image having predetermined gradations by using a plurality of nozzles with different quantities of ejection, the ink jet printer 100 changes the pulse number by using PNM, thus controlling the quantity of ejection of ink drops from the nozzles and correcting the unevenness in the quantity of ejection among the nozzles.

For example, a nozzle which ejects 3 pl of ink drops, the target quantity of ejection for each nozzle per pulse, and a nozzle which can only eject 2.5 pl of ink drops per pulse, are considered. Since ink drops for 8 pulses at the maximum are used for recording one pixel, the quantity of ejection should be 3 pl, 6 pl, 9 pl, 12 pl, 15 pl, 18 pl, 21 pl and 24 pl, respectively, for eight levels. However, with the nozzle having the quantity of ejection of 2.5 pl per pulse, only 2.5 pl, 5 pl, 7.5 pl, 10 pl, 12.5 pl, 15 pl, 17.5 pl and 20 pl of ink drops are ejected, respectively. Therefore, the difference in the quantity of ejection is −0.5 pl, −1 pl, −1.5 pl, −2 pl, −2.5 pl, −3 pl, −3.5 pl, and −4 pl for the respective levels.

When ink drops are to be ejected from the nozzle having the quantity of ejection of 2.5 pl per pulse, the quantity of ejection is caused to be 2.5 pl, 5 pl, 10 pl, 12.5 pl, 15 pl, 17.5 pl, 20 pl and 25 pl by generating one pulse, 2 pulses, 4 pulses, 5 pulses, 6 pulses, 7 pulses, 8 pulses and 10 pulses. Therefore, the difference in the quantity of ejection between the nozzle of 2.5 pl per pulse and the nozzle of 3 pl per pulse is −0.5 pl, −1 pl, +1 pl, +0.5 pl, 0 pl, −0.5 pl, −1 pl and +1. The difference in the quantity of ejection can be restrained to 1 pl at the maximum.

Meanwhile, a nozzle with the quantity of ejection of 3.5 pl per pulse is considered. The quantity of ejection 3.5 pl, 7 pl, 10.5 pl, 14 pl, 17.5 pl, 21 pl, 24.5 pl and 28 pl, respectively, for eight levels. Therefore, the difference in the quantity of ejection between this nozzle and the nozzle of 3 pl per pulse is +0.5 pl, +1 pl, +1.5 pl, +2 pl, +2.5 pl, +3 pl, +3.5 pl and +4 pl for the respective levels.

When ink drops are to be ejected form the nozzle having the quantity of ejection of 3.5 pl per pulse, the quantity of ejection is caused to be 3.5 pl, 7 pl, 10.5 pl, 10.5 pl, 14 pl, 17.5 pl, 21 pl and 24.5 pl by generating one pulse, 2 pulses, 3 pulses, 3 pulses, 4 pulses, 5 pulses, 6 pulses and 7 pulses. Therefore, the difference in the quantity of ejection between this nozzle and the nozzle of 3 pl per pulse is +0.5 pl, +1 pl, +1.5 pl, −1.5 pl, −1 pl, −0.5 pl, 0 pl and +0.5 pl for the respective levels. The difference in the quantity of ejection can be restrained to 1.5 pl at the maximum.

In this manner, when producing a recorded image having predetermined gradations by using a plurality of nozzles with different quantities of ejection, the ink jet printer 100 changes the number of ink drops to be ejected from each nozzle and corrects the unevenness in the quantity of ejection among the nozzles. Thus, the ink jet printer 100 can control the quantity of ejection of ink drops from the nozzles and can restrain the difference in the quantity of ejection per pixel.

Figure 19A:
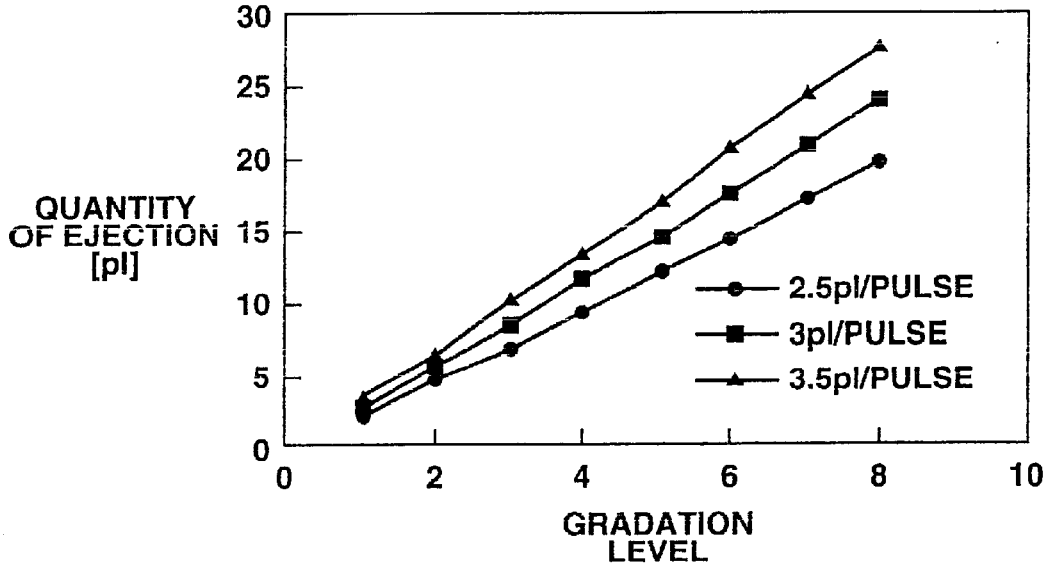
FIG. 19A shows the relation between the gradation level and the quantity of ejection before the pulse number is corrected in accordance with the quantity of ejection from the nozzles.
Figure 19B:
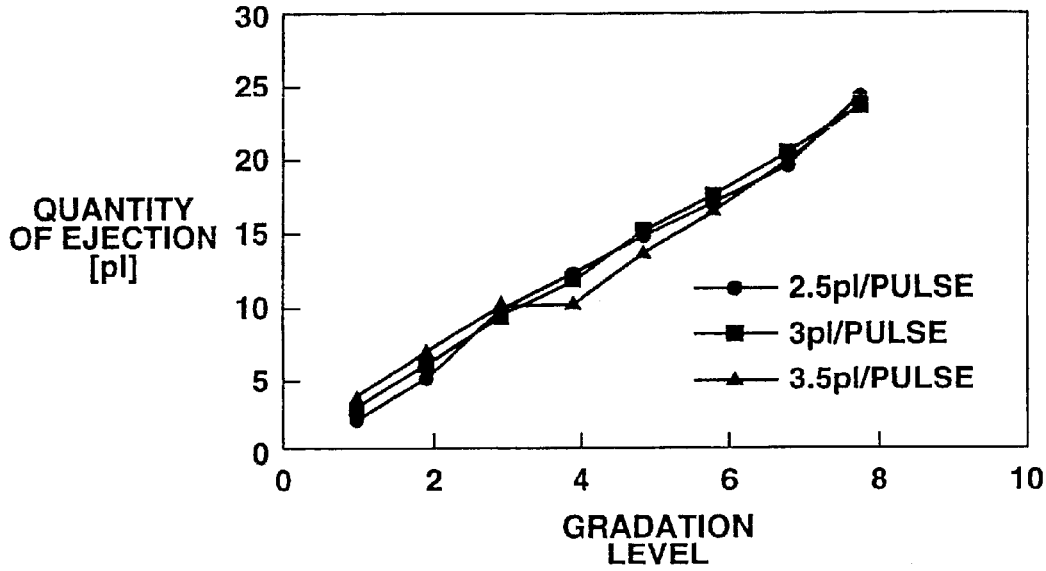
FIG. 19B shows the relation between the gradation level and the quantity of ejection after the pulse number is corrected in accordance with the quantity of ejection from the nozzles.

FIG. 19A shows the relation between the gradation level and the quantity of ejection before the pulse number is corrected in accordance with the quantity of ejection from the nozzles. FIG. 19B shows the relation between the gradation level and the quantity of ejection after the pulse number is corrected in accordance with the quantity of ejection from the nozzles. As can be seen from FIGS. 19A and 19B, if the pulse number is not corrected in accordance with the quantity of ejection from the nozzles, the quantity of ejection necessary for expressing the same gradation level differs among the nozzles. On the other hand, if the pulse number is corrected in accordance with the quantity of ejection from the nozzles, the quantity of ejection necessary for expressing the same gradation level is substantially the same among the respective nozzles.

Figure 20:
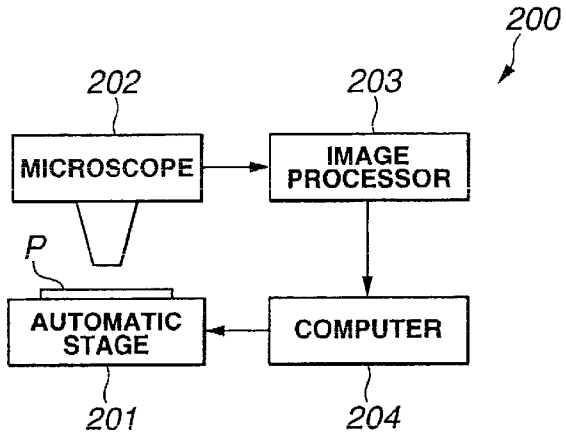
FIG. 20 is a block diagram showing the structure of an automatic measuring device for measuring the diameter of a dot.

An ejection test is carried out for all the nozzles and the quantity of ejection from each nozzle is measured on the basis of the diameter of each dot recorded on the paper. The relation between the quantity of ejection and the diameter of the dot is found in a measurement graph, which is prepared separately. The diameter of the dot is measured by an automatic measuring device 200 having at least a microscope 202 and an image processor 203, as shown in FIG. 20.

Specifically, in the automatic measuring device 200, a dot recorded on the paper P on an automatic stage 201 is read by the image processor 203 using the microscope 202, and the quantity of ejection is calculated by a computer 204 on the basis of the diameter of the dot. The automatic measuring device 200 carries out such an operation for all the nozzles and prepares a correction table relating to the pulse number corresponding to each nozzle.

In the ink jet printer 100, the correction table thus prepared is stored in the correcting circuit 162 as the correction data. At the time of recording, the ink jet printer 100 determines the pulse number for each nozzle on the basis of the correction data and controls the quantity of ejection of ink drops so as to carry out recording.

The pulse number thus corrected sometimes exceeds 8, which is presented as the standard maximum pulse number in Table 1. Therefore, the ink jet printer 100 needs to preset a slightly large value for the maximum pulse number for recording, and determines the maximum pulse number in accordance with the unevenness in the quantity of ejection. If the unevenness is within the range of 3±0.5 pl as in the above-described example, since the minium quantity of ejection is 2.5 pl, the maximum pulse number may be 10. In this case, the ejection frequency must be 6 kHz (or higher) to meet the line recording frequency of 600 Hz.

In this manner, when producing a recorded image having predetermined gradations by using a plurality of nozzles with different quantities of ejection, the ink jet printer 100 changes the pulse number by using PNM. Thus, the ink jet printer 100 can control the quantity of ejection of ink drops from the nozzles and can correct the unevenness in the quantity of ejection among the nozzles. By thus correcting the unevenness in the print density, the ink jet printer 100 can provide a smoother recorded image of high definition.

The method for ejecting ink drops by the ink jet printer 100 will now be described.

Figure 21:
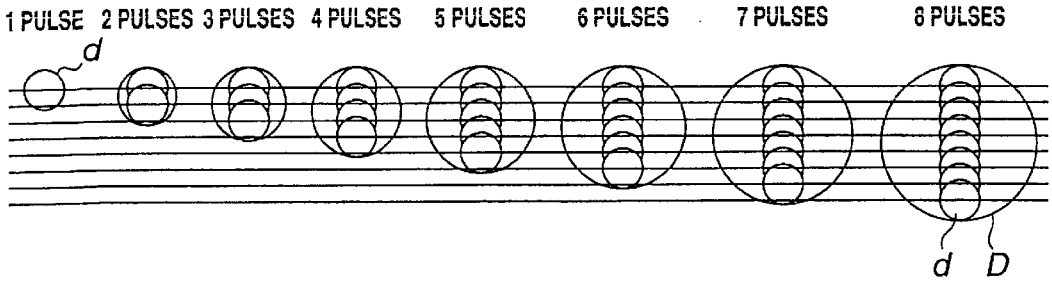
FIG. 21 shows the state of dots formed in the case where the pulse number is increased with reference to a given time point irrespective of the recording direction in performing PNM.

In the ink jet printer, the paper moves relatively to the line head as described above. Therefore, in carrying out PNM, when the pulse number is increased from a reference time point as shown in FIG. 21, the tendency becomes noticeable such that the center of a dot D, formed by dots d based on respective ink drops on the paper correspondingly to each pulse, shifts rearward with respect to the paper feed direction.

Figure 22A:
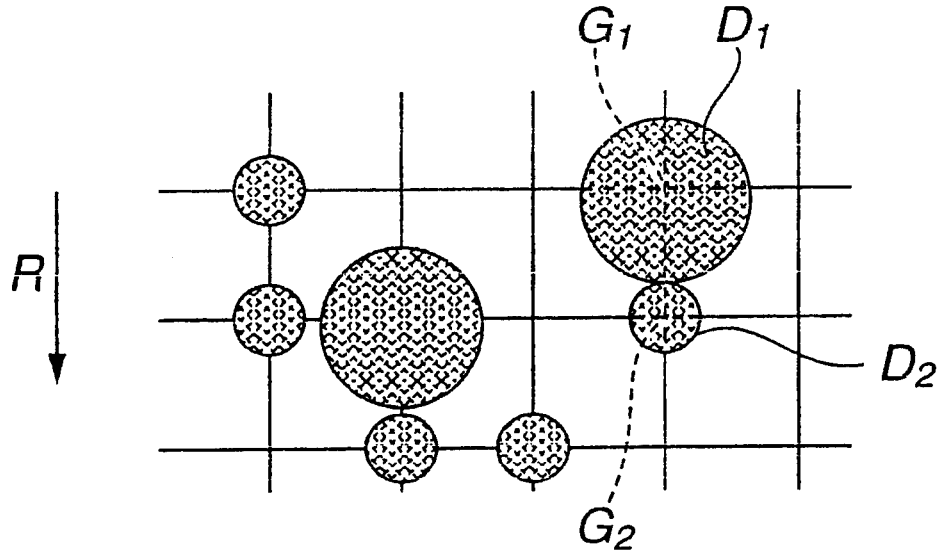
FIG. 22A shows the state of each dot to be recorded on paper, in which each dot is recorded so that the center of each dot is located at a lattice point.

For example, it is assumed that recording should be carried out so that the centers of dots are situated on respective lattice points on the paper, as shown in FIG. 22A. In FIG. 22A, a dot $D_1$ with a large diameter and a dot $D_2$ with a small diameter are shown. Since these dots $D_1$, $D_2$ are recorded on predetermined lattice points $G_1$, $G_2$ where these dots should be recorded, the dots $D_1$, $D_2$ dot not overlap each other.

Figure 22B:
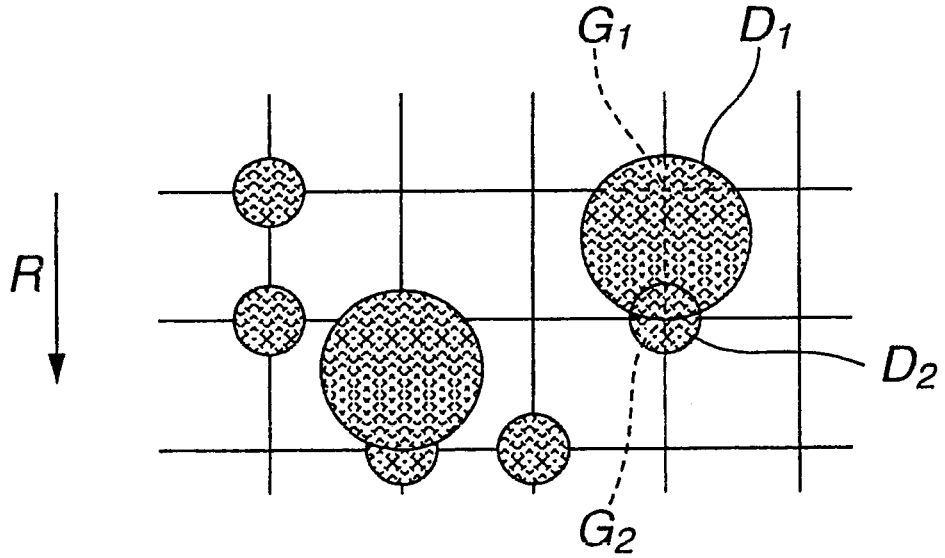
FIG. 22B shows the state of each dot to be recorded on paper, in which a dot with a large diameter is recorded so that the center of the dot with a large diameter is not located at a predetermined lattice point for recording.

However, in carrying out PNM, if the pulse number is increased from a reference time point without considering the recording direction (opposite of the paper feed direction) indicated by an arrow R in FIG. 22A, the center of the dot $D_1$ with a large diameter is not recorded on the predetermined lattice point $G_1$ where it should be recorded, as shown in FIG. 22B. That is, the dot $D_1$ is shifted in the direction of the arrow R in FIG. 22B. As a result, the dot $D_1$ is recorded, overlapping the next recorded dot $D_2$.

As described above, in carrying out PNM in the ink jet printer, if the pulse number is increased from a reference time point without considering the recording direction, the center of a dot with a large diameter is shifted from the lattice point where the dot should be formed, and this causes failure in recording such that a straight line to be recorded is actually recorded as a curved line. Therefore, accurate recording cannot be carried out.

Thus, in order to avoid such a problem in carrying out PNM, the ink jet printer 100 distributes ink drops in the paper feed direction from the lattice point as the center, thus carrying out recording.

Figure 23A:
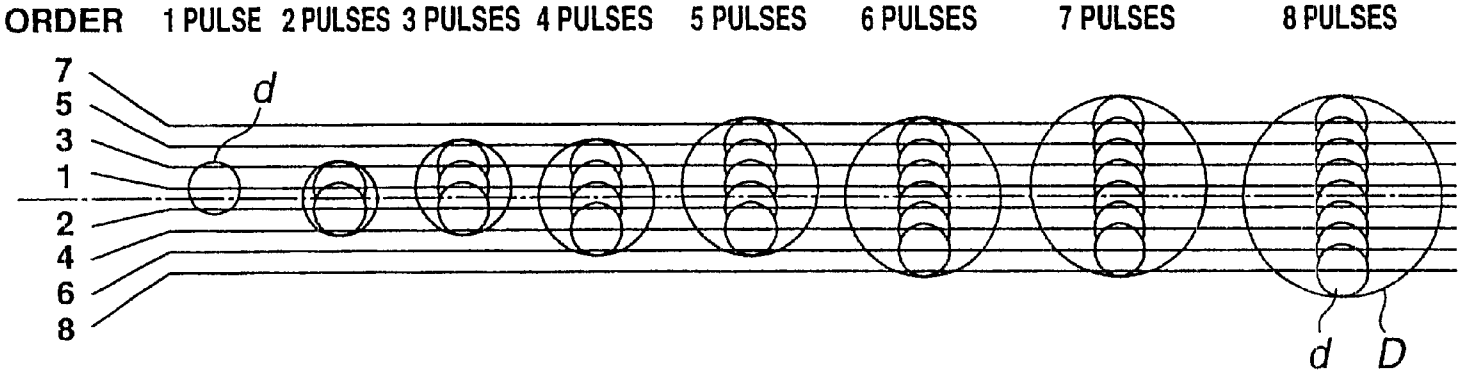
FIG. 23A shows the state of dots formed when recording is carried out by dropping ink drops on paper so that the ink drops are distributed in the paper feed direction from the lattice point as the center, in carrying out PNM in which the pulse number is "8."

For example, when the pulse number is "8," the ink jet printer 100 sequentially distributes ink drops in the direction of the paper feed direction from the lattice point as the center indicated by a chain-dotted line in FIG. 23A, corresponding to the pulses of odd ordinal numbers and the pulses of even ordinal numbers of the first to eighth pulses, as shown in FIG. 23A. The ink jet printer 100 thus forms dots d and records a dot D with an ultimate diameter.

Figure 23B:
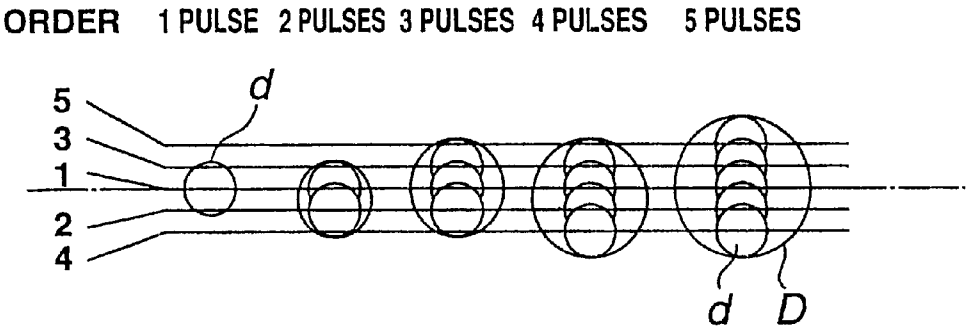
FIG. 23B shows the state of dots formed when recording is carried out by dropping ink drops on paper so that the ink drops are distributed in the paper feed direction from the lattice point as the center, in carrying out PNM in which the pulse number is "5."

When the pulse number is "5," the inkjet printer 100 drops an ink drop to form a dot d on the lattice point indicated by a chain-dotted line in FIG. 23B, for the first pulse, as shown in. FIG. 23B. For the second to eighth pulses, the ink jet printer 100 sequentially distributes ink drops in the paper feed direction from the lattice point as the center, corresponding to the pulses of odd ordinal numbers and the pulses of even ordinal numbers. The ink jet printer 100 thus forms dots d and records a dot D with an ultimate diameter.

In this manner, the ink jet printer 100 carries out recording by sequentially distributing ink drops in the paper feed direction from the lattice point as the center, corresponding to the pulse numbers. In this case, if a dot D is to be formed by ink drops of even ordinal numbers, the ink jet printer 100 sequentially distributes ink drops of odd ordinal numbers and ink drops of even ordinal numbers in the paper feed direction from the lattice point as the center. If a dot D is to be formed by ink drops of odd ordinal numbers, the ink jet printer 100 drops the first ink drop on the lattice point and then sequentially distributes ink drops of odd ordinal numbers and ink drops of even ordinal numbers in the paper feed direction from the lattice point as the center. Thus, the ink jet printer 100 can minimize the deviation of the formed dot from the lattice point and can prevent curving of a straight line and unwanted overlapping of dots.

As described above, the ink jet printer 100 can realize multi-level recording within a pixel by carrying out PNM. Therefore, the ink jet printer 100 can provide a recorded image of high definition with less rough or granular appearance at a high speed, in comparison with the conventional ink jet printer.

Moreover, by combining PNM with dot density modulation, the ink jet printer 100 can carry out not only binary but also multi-level dot density modulation and can carry out smoother gray scale printing of high definition. As a result, the ink jet printer 100 can realize high definition with a small number of nozzles and therefore can reduce the number of nozzles and the work and assembly cost.

By setting the recording time in consideration of the ink drying time and then carrying out time-division driving of multiple divisions which fully uses the recording time, the ink jet printer 100 can reduce the dissipation power.

The ink jet printer 100 can also carry out correction of the quantity of ejection, that is, correction of the print density, using PNM, and thus can provide a smoother recorded image of high definition.

By sequentially distributing ink drops in the paper feed direction from the lattice point as the center, the ink jet printer 100 can provide a more accurate recorded image of high definition.

Moreover, by arranging the plurality of head chips 121 in a zigzag manner and providing the overlap part $\mathbf{124}_C$, the ink jet printer 100 can restrain the banding noise generated at the joint of the head chips 121, that is, at the joint of the nozzle groups.

Thus, the ink jet printer 100 is well balanced as a whole with respect to the picture quality, the speed and the dissipation power, and provides convenience for users.

The present invention is not limited the above-described embodiment. For example, though the line head is used in the above-described embodiment, the present invention can also be applied to a serial head as long as it is a print head for scanning the same portion on the paper only once in one print, that is, a print head for carrying out so-called one-path recording.

Moreover, though the system for ejecting ink drops using the thermal system is employed and the heating elements are used as driving elements in the above-described embodiments, the present invention can also be applied to a piezo system using piezoelectric elements as driving elements, despite the increase in scale and the reduction in resolution in comparison with the thermal system.

Thus, various modifications and changes may be effected without departing from the scope of the present invention.

Industrial Applicability

As is described above in detail, in the method for driving a print head in an ink jet printer according to the present invention, ink drops are ejected from a plurality of nozzles and dropped on a recording medium so that information including a character and/or an image is recorded in the form of dots based on the ink drops. The print head having a driving element for ejecting ink drops from the nozzles is caused to scan the same portion on the recording medium only once in one print, and to drive the print head to modulate the diameter of a dot by the number of ink drops, using one or a plurality of ink drops for forming one dot.

Thus, with the method for driving a print head in an ink jet printer according to the present invention, by driving the print head to modulate the diameter of a dot by the number of ink drops, the gradation can be expressed within a pixel and a recorded image of high definition with less rough or granular appearance can be provided at a high speed.

Moreover, in the ink jet printer according to the present invention, ink drops are ejected from a plurality of nozzles and dropped on a recording medium, thus recording information including a character and/or an image in the form of dots based on the ink drops. The ink jet printer has a print head having a driving element for ejecting ink drops from the nozzles. In the ink jet printer, the print head is caused to scan the same portion on the recording medium only once in one print and is driven to modulate the diameter of a dot by the number of ink drops, using one or a plurality of ink drops for forming one dot.

Thus, with the ink jet printer according to the present invention, by driving the print head to modulate the diameter of a dot by the number of ink drops, the gradation can be expressed within a pixel and a recorded image of high definition with less rough or granular appearance can be provided at a high speed.

What is claimed is:

1. A method for driving a print head in an ink jet printer in which ink drops are ejected from a plurality of nozzles and dropped on a recording medium so that information including a character and/or an image is recorded in the form of dots based on the ink drops, the method comprises the steps of causing the print head controlled by pulse number modulation and driven by time-divisional driving and having a driving element for ejecting ink drops from the nozzles to scan a same portion on the recording medium only once in one print, and driving the print head to modulate a diameter of the dot by the number of ink drops, using one or a plurality of ink drops for forming one dot, wherein the print head is a line head immovably fixed on the ink jet printer and extending a page-width direction thereacross and the plurality of nozzles are arranged in blocks alternating in a zigzag manner across the entire print head in the page-width direction.

2. The method for driving the print head in the ink jet printer as claimed in claim 1, wherein in order to form the one dot, the ink jet printer drops the next ink drop onto the recording medium before the first ink drop dropped on the recording medium is dried to modulate the diameter of the dot.

3. The method for driving a print head in an ink jet printer as claimed in claim 2, wherein when mixing the ink drops of a plurality of colors by using each of the print heads for a plurality of colors, the ink jet printer drops the ink drop of one color onto the recording medium and drops the next ink drop of a different color onto the recording medium after the dot recorded by the first ink drop is dried.

4. The method for driving the print head in the ink jet printer as claimed in claim 1, wherein when producing a recorded image having a predetermined gradation by using a plurality of nozzles with different quantities of ejection, the ink jet printer changes the number of ink drops ejected from each nozzle to correct an unevenness in the quantity of ejection among the nozzles.

5. The method for driving the print head in the ink jet printer as claimed in claim 1, wherein the ink jet printer distributes the ink drops in the feed direction of the recording medium from a lattice point as the center, which is a position on the recording medium for forming the one dot with the one ink drop, and thus drops the ink drops to carry out recording.

6. The method for driving the print head in the ink jet printer as claimed in claim 5, wherein when forming the one dot with the ink drops of even ordinal numbers, the ink jet printer sequentially distributes the ink drops of odd ordinal numbers and the ink drops of even ordinal numbers in the feed direction of the recording medium from the lattice point as the center, thus dropping the ink drops, and when forming the one dot with the ink drops of odd ordinal numbers, the ink jet printer drops the first ink drop on the lattice point and sequentially distributes the ink drops of odd ordinal numbers and the ink drops of even ordinal numbers in the feed direction of the recording medium from the lattice point as the center.

7. An ink jet printer for ejecting and dropping ink drops from a plurality of nozzles onto a recording medium and recording information including a character and/or an image in the form of dots based on the ink drops, the ink jet printer comprising a print head having a driving element for ejecting ink drops from the nozzles, wherein the print head is controlled by pulse number modulation and driven by time-divisional driving, the print head is caused to scan a same portion on the recording medium only once in one print is driven to modulate a diameter of the dot by the number of ink drops, using one or a plurality of ink drops for forming one dot and is a line head immovably fixed on the ink jet printer and extending in a page-width direction thereacross, the plurality of nozzles arranged in blocks alternating in a zigzag manner across the entire print head in the page-width direction.

8. A method for driving a print head in an ink jet printer in which ink drops are ejected from a plurality of nozzles and dropped on a recording medium so that information including a character and/or an image is recorded in the form of dots based on the ink drops, the method comprises the steps of causing the print head controlled by pulse number modulation and having a plurality of driving elements for ejecting the ink drops from the plurality of nozzles and driving the driving elements in a time-divisional manner, to scan a same portion on the recording medium only once in one print and driving the print head to modulate a diameter of the dot by the number of ink drops, using one or a plurality of ink drops for forming one dot, wherein the print head is a line head immovably fixed on the ink jet printer and extending a page-width direction thereacross, the plurality of nozzles arranged in blocks alternating in a zigzag manner across the entire print head in the page-width direction.

9. The method for driving the print head in the ink jet printer as claimed in claim 8, wherein in order to form the one dot, the ink jet printer drops the next ink drop onto the recording medium before the first ink drop dropped on the recording medium is dried, thus modulating the diameter of the dot.

10. The method for driving the print head in the ink jet printer as claimed in claim 9, wherein when mixing the ink drops of a plurality of colors by using each of the print heads for a plurality of colors, the ink jet printer drops the ink drop of one color onto the recording medium and drops the next ink drop of a different color onto the recording medium after the dot recorded by the first ink drop is dried.

11. The method for driving the print head in the ink jet printer as claimed in claim 8, wherein when producing a recorded image having a predetermined gradation by using a plurality of nozzles with different quantities of ejection, the ink jet printer changes the number of ink drops ejected from each nozzle, thus correcting the unevenness in the quantity of ejection among the nozzles.

12. The method for driving the print head in the ink jet printer as claimed in claim 8, wherein the ink jet printer distributes the ink drops in the feed direction of the recording medium from a lattice point as the center, which is a position on the recording medium for forming the one dot with the one ink drop, and thus drops the ink drops to carry out recording.

13. The method for driving the print head in the ink jet printer as claimed in claim 12, wherein when forming the one dot with the ink drops of even ordinal numbers, the ink jet printer sequentially distributes the ink drops of odd ordinal numbers and the ink drops of even ordinal numbers in the feed direction of the recording medium from the lattice point as the center, thus dropping the ink drops, and when forming the one dot with the ink drops of odd ordinal numbers, the ink jet printer drops the first ink drop on the lattice point and sequentially distributes the ink drops of odd ordinal numbers and the ink drops of even ordinal numbers in the feed direction of the recording medium from the lattice point as the center.

14. An ink jet printer for ejecting and dropping ink drops from a plurality of nozzles onto a recording medium and recording information including a character and/or an image in the form of dots based on the ink drops, the ink jet printer comprising a print head having driving elements for ejecting ink drops from the plurality of nozzles and driving the driving elements in a time-divisional manner, wherein the print head is controlled by pulse number modulation and driven by time-divisional driving and is caused to scan a same portion on the recording medium only once in one print, is driven to modulate a diameter of the dot by the number of ink drops, using one or a plurality of ink drops for forming one dot and is a line head immovably fixed on the ink jet printer and extending in a page-width direction thereacross, the plurality of nozzles arranged in blocks alternating in a zigzag manner across the entire print head in the page-width direction.

* * * * *